US005844535A

United States Patent [19]

Itoh et al.

[11] Patent Number: 5,844,535

[45] Date of Patent: Dec. 1, 1998

[54] LIQUID CRYSTAL DISPLAY IN WHICH EACH PIXEL IS SELECTED BY THE COMBINATION OF FIRST AND SECOND ADDRESS LINES

[75] Inventors: Goh Itoh, Tokyo; Haruhiko Okumura, Fujisawa; Hisao Fujiwara, Yokohama, all of Japan

[73] Assignee: Kabushiki Kaisha Toshiba, Kawasaki, Japan

[21] Appl. No.: 666,262

[22] Filed: Jun. 20, 1996

[30] Foreign Application Priority Data

Jun. 23, 1995 [JP] Japan ..... 7-157910

[51] Int. Cl.[6] ..... G09G 3/36

[52] U.S. Cl. ..... 345/92; 345/103

[58] Field of Search ..... 345/87, 88, 92, 345/93, 99, 103, 98; 349/36, 33, 42, 41, 48

[56] References Cited

U.S. PATENT DOCUMENTS

| | | | |
|---|---|---|---|
| 4,532,506 | 7/1985 | Kitazima et al. | 345/92 |
| 5,206,632 | 4/1993 | Dupont et al. | 345/92 |
| 5,691,783 | 11/1997 | Numao et al. | 345/92 |

FOREIGN PATENT DOCUMENTS

| | | |
|---|---|---|
| 0 112 700 | 7/1984 | European Pat. Off. . |
| 0 495 428 | 7/1992 | European Pat. Off. . |
| 0 552 952 | 7/1993 | European Pat. Off. . |
| 0 586 155 | 3/1994 | European Pat. Off. . |
| 43 44 808 | 7/1994 | Germany . |
| 3-271795 | 12/1991 | Japan . |
| 7-64051 | 3/1995 | Japan . |

*Primary Examiner*—Chanh Nguyen

*Attorney, Agent, or Firm*—Oblon, Spivak, McClelland, Maier & Neustadt, P.C.

[57] ABSTRACT

A liquid crystal display includes a liquid crystal display panel having a pixel matrix consisting of a plurality of pixels, a signal line driver, a row address line driving circuit, a row pixel counter circuit, a row address signal generating circuit, a column address line driving circuit, a column pixel counter circuit, and a column address signal generating circuit. Each pixel includes a liquid crystal unit, a storage capacitor, and a switching unit consisting of switching devices. The switching unit is turned on and off by a cooperation of a row address line and a column address line. While the switching unit is ON, an image signal is supplied from a signal line to a pixel electrode. This reduces write operations to pixels and thereby reduces the power consumption, and also improves the writing characteristic and the holding characteristic which differ from one pixel to another.

20 Claims, 27 Drawing Sheets

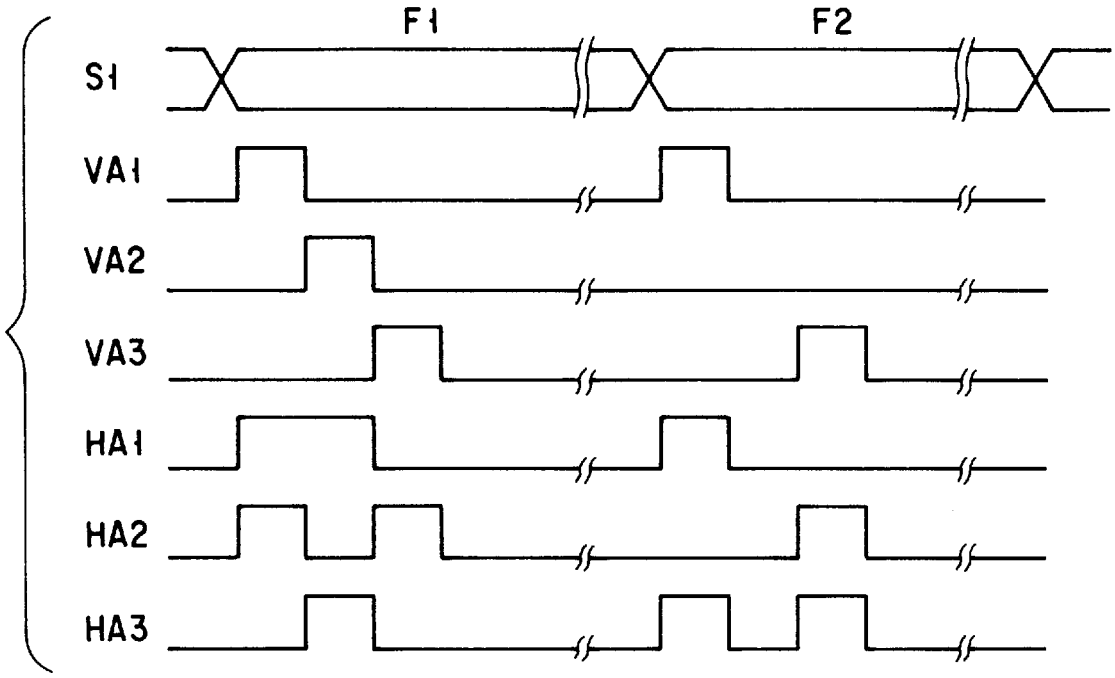
FIG. 3A
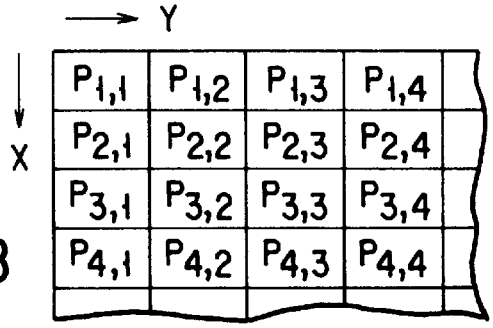
FIG. 3B
F1
| | | |
|---|---|---|
| ON | ON | OFF |
| ON | OFF | ON |
| OFF | ON | OFF |
FIG. 3C
F2
| | | |
|---|---|---|
| ON | OFF | ON |
| OFF | OFF | OFF |
| OFF | ON | ON |
FIG. 3D

LIQUID CRYSTAL DISPLAY IN WHICH EACH PIXEL IS SELECTED BY THE COMBINATION OF FIRST AND SECOND ADDRESS LINES

BACKGROUND OF THE INVENTION

1. Field of the Invention

The present invention relates to a liquid crystal display for displaying an image by using a pixel matrix defined by rows and columns of pixels and, more particularly, to a liquid crystal display capable of controlling an image signal in units of a pixel or a pixel group.

2. Description of the Related Art

Liquid crystal displays are thin and light in weight and can be driven with low voltages. Therefore, liquid crystal displays are widely used in word processors, personal computers, and compact game machines as well as in wrist watches and pocket calculators. Recently, the need for liquid crystal displays as pen-input electronic notebooks is increasing, and so the demand for liquid crystal displays for use in Personal Digital Assistances (PDA) is also increasing.

On the other hand, since a plurality of programs need to become simultaneously displayed on the same screen as the multimedia systems progress, it becomes necessary to increase the size and the resolution of a screen. This also increases the information amount and raises the driving frequency. Accordingly, it becomes necessary to develop ICs capable of operating at high speeds.

Furthermore, the power consumption increases as the driving frequency rises, and so a driving method (e.g., Japanese Patent Application No. 2-69706) by which the power consumption is decreased is proposed to solve this problem. In this specification, this method is called a multi-field driving method.

In conventional liquid crystal displays, address lines and signal lines are extended along rows and columns, or columns and rows, respectively, of a pixel matrix. To write an image signal into each pixel, the address lines are sequentially scanned from the top, switching devices connected to the scanned address lines are turned on, and signals from signal lines are written in pixel electrodes. In this operation, switching devices in the same row connected to the same address line must be turned on, and respective desired signals must be supplied to pixels in the same row. That is, even when the same image as in the preceding field is to be displayed in the next field, the same image signal must be supplied to the signal line.

Since it is necessary to invert the polarity in a liquid crystal driving method, image signals with polarities alternately inverted are applied even when the same image is displayed. However, the driving frequency can be lowered provided that the liquid crystal does not deteriorate. In the multi-field driving method described above, each frame is constituted by a plurality of subfields. Therefore, the driving frequency of one pixel is divided by the number of subfields and lowered, and this greatly reduces the power consumption.

On the other hand, when the multi-field driving method is used in conventional liquid crystal displays such that a dynamic image is displayed in a window and a still image is displayed outside the window, the same driving frequency is used inside and outside the window. Consequently, the driving frequency is low even for pixels for displaying a dynamic image on address lines connected to pixels for displaying a still image. This results in an image-lag phenomenon.

Also, when image signals are written into pixels, different image signals have different writing characteristics to pixels. This writing characteristic is determined by the correlation between the gate voltage of an address line and an image signal. Additionally, in a holding period during which no write operation is performed, the holding characteristic of a switching device changes in accordance with the potential of a pixel electrode. This holding characteristic depends upon the gate potential of an address line. Accordingly, if various image signals are supplied to pixel electrodes by the same gate voltage, the image quality differs from one pixel signal to another, resulting in a degraded image quality.

As a liquid crystal display capable of lowering the power consumption, a structure including a memory for each pixel is proposed (Jpn. Pat. Appln. KOKAI Publication No. 58-196582 or 3-77922). When this technology is used, a display signal of a still image need only be transferred once to each pixel. Thereafter, it is only necessary to constantly display each pixel by using the signal stored in the memory of the pixel. Accordingly, the power consumption is theoretically equal to the power consumption for inverting the polarity. The result is that the power consumption infinitely approaches "0" for still images.

Recently, however, the multimedia systems are advancing and the need to display dynamic images is increasing accordingly. A dynamic image is an image whose pixel information successively changes at a high rate. Therefore, even if each pixel has a memory, the pixel signal in the memory must be rewritten frequently. When pixels are thus rewritten frequently, a large power is consumed as in conventional displays.

SUMMARY OF THE INVENTION

It is, therefore, an object of the present invention to greatly reduce the power consumed by a write operation to a pixel requiring no write operation in a pixel matrix.

It is another object of the present invention to improve the writing characteristic and the holding characteristic which differ from one pixel to another, by changing the gate voltage of a switching device connected to a pixel from one pixel to another.

According to a first aspect of the present invention, there is provided a display comprising:

- a pixel matrix defined by rows and columns of a plurality of pixels;
- an image signal supply for supplying an image signal to the pixels;
- a first addressor for selecting the rows of the pixel matrix;
- a second addressor for selecting pixel groups each consisting of a plurality of pixels of the pixel matrix;
- wherein an image signal is supplied to a pixel while the row and the pixel group, which the pixel belongs to, are selected.

According to a second aspect of the present invention, there is provided a liquid crystal display comprising:

- a pixel matrix defined by rows and columns of a plurality of pixels each having a pixel electrode;
- a plurality of signal lines for supplying an image signal to the pixel electrodes;
- a signal line driver for supplying an image signal to the signal lines;
- a plurality of switching units for respectively connecting the signal lines to the pixel electrodes;
- a plurality of first address lines for selecting the rows of the pixel matrix;

a first address line driving circuit for supplying a scan signal to the first address lines;

a plurality of second address lines for selecting pixel groups each consisting of a plurality of pixels of the pixel matrix; and a second address line driving circuit for supplying a scan signal to the second address lines, wherein the switching unit is turned on and off by the first and second address lines, and an image signal is supplied to the pixel while the switching unit is turned on.

According to a third aspect of the present invention, there is provided a liquid crystal display comprising:

a pixel matrix defined by rows and columns of a plurality of pixels each having a pixel electrode;

a plurality of signal lines for supplying an image signal to the pixel electrodes;

a signal line driver for supplying an image signal to the signal lines;

a plurality of first switching units for respectively connecting the signal lines to the pixel electrodes, each of the first switching units having a first switching element and a rectifying element;

a plurality of first address lines for selecting the rows of the pixel matrix, the first switching elements being turned on and off by the first address lines;

a first address line driving circuit for supplying a scan signal to the first address lines;

a plurality of reset signal lines for supplying a reset signal to the pixel electrodes;

a plurality of second switching units for connecting the reset signal lines to the pixel electrodes, each of the second switching units having a second switching element;

a plurality of second address lines for selecting pixel groups each consisting of a plurality of pixels of the pixel matrix, the second switching elements being turned on and off by the second address lines; and a second address line driving circuit for supplying a scan signal to the second address lines, wherein an image signal passes through the rectifying element corresponding to a pixel to which a reset signal has been supplied.

According to a fourth aspect of the present invention, there is provided a liquid crystal display comprising:

a pixel matrix defined by rows and columns of a plurality of pixels each having a pixel electrode;

a plurality of signal lines for supplying an image signal and a reset signal to the pixel electrodes;

a signal line driver for supplying an image signal and a reset signal to the signal lines;

a plurality of first switching units for respectively connecting the signal lines to the pixel electrodes to supply an image signal to the pixel electrodes, each of the first switching units having a first switching element and a first rectifying element;

a plurality of second switching units for respectively connecting the signal lines to the pixel electrodes to supply a reset signal to the pixel electrodes, each of the second switching units having a second switching element and a second rectifying element, and the first and second rectifying elements performing rectification with opposite polarities between the signal line and the pixel electrode;

a plurality of first address lines for selecting the rows of the pixel matrix, the first switching elements being turned on and off by the first address lines;

a plurality of second address lines for selecting pixel groups each consisting of a plurality of pixels of the pixel matrix, the second switching elements being turned on and off by the second address lines; and an address line driving circuit for supplying a scan signal to the first and second address lines, wherein an image signal passes through the first rectifying element corresponding to a pixel to which a reset signal has been supplied through the second rectifying element.

Note that the aperture ratio of pixels may be decreased by an increase in the number of address lines. However, this problem can be eliminated by making some address lines and signal lines overlap each other in the direction of thickness. This problem can also be eliminated by designing the display as a reflection type LCD in which each pixel electrode functions as a reflection surface and by arranging connecting lines and switching units at the back of these pixel electrodes.

In this liquid crystal display of the present invention, pixels or pixel groups of a pixel matrix can be selectively driven. Accordingly, the selection between pixels to be rewritten and pixels not to be rewritten in one frame can be performed not only for rows (e.g., vertical addresses) but also for columns (e.g., horizontal addresses) or pixel groups (e.g., pixel block addresses). This eliminates the need to output a signal to each pixel not requiring rewriting and thereby reduces the power consumption.

As an example, when it is necessary to simultaneously display a dynamic image and a still image on the same screen in a window display method, pixels for displaying the dynamic image and pixels for displaying the still image can be independently driven. Consequently, the driving frequency of the pixels displaying the still image can be decreased to the level which is not visually recognized by the visual property. This greatly reduces the power consumption.

Although flicker may occur in this case, required image quality can be maintained by designing the display such that compensation is possible between adjacent pixels, as is well known in multi-field driving.

Furthermore, the liquid crystal display of the second aspect can also be provided with means for driving switching units at respective different frequencies so that pixels can be rewritten at respective different periods. Since the driving frequency can be changed from one pixel to another, the driving frequency can be changed in accordance with image information. Consequently, the driving frequencies can differ between image information which readily causes flicker and image information which does not cause flicker easily. This makes it possible to optimize the power consumption for each display image regardless of whether the image is a still image or a dynamic image, and to improve the image quality. When an image signal which is prone to cause flicker is written, for the same display image, this image signal can be set in a region which is not visually recognized by the visual property, by performing a selective scanning.

For example, when a dynamic image is displayed in a window while a still image is displayed outside the window, only the driving frequency of pixels for displaying the dynamic image can be changed. Therefore, portions of the same color in the still image outside the window can be driven at the same driving frequency. This prevents a luminance variation caused by the difference among driving frequencies.

The liquid crystal display of the second aspect can also be provided with means for varying the gate voltage of the second switching element connected to the pixel electrode by using a voltage supplied to the second address line. Accordingly, the gate voltage during a sampling period can be changed in accordance with an image signal to a pixel. As a consequence, when different image signals are written in pixels in the same row, the gate voltage during the sampling period can be changed from one pixel to another, and this allows optimization of the writing characteristic of each individual pixel. Also, the first address lines are scanned even in a holding period and, if the first switching element is ON, the gate voltage during the holding period can be changed from one pixel to another. Consequently, when different image information are input to pixels in the same row, a luminance change during the holding period can be optimized for each individual pixel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 3A to 3D are views showing the signal waveforms of the individual components and the selected states of pixels in the display shown in FIG. 1A;

DETAILED DESCRIPTION OF THE PREFERRED EMBODIMENTS

Embodiments of the present invention will be described in detail below. Note that in the following embodiments, the functions of a row address line and a column address line are interchangeable.

(First Embodiment)

In the first embodiment, individual pixels present at the intersections of row address lines and column address lines are selectively driven.

Figure 1A:
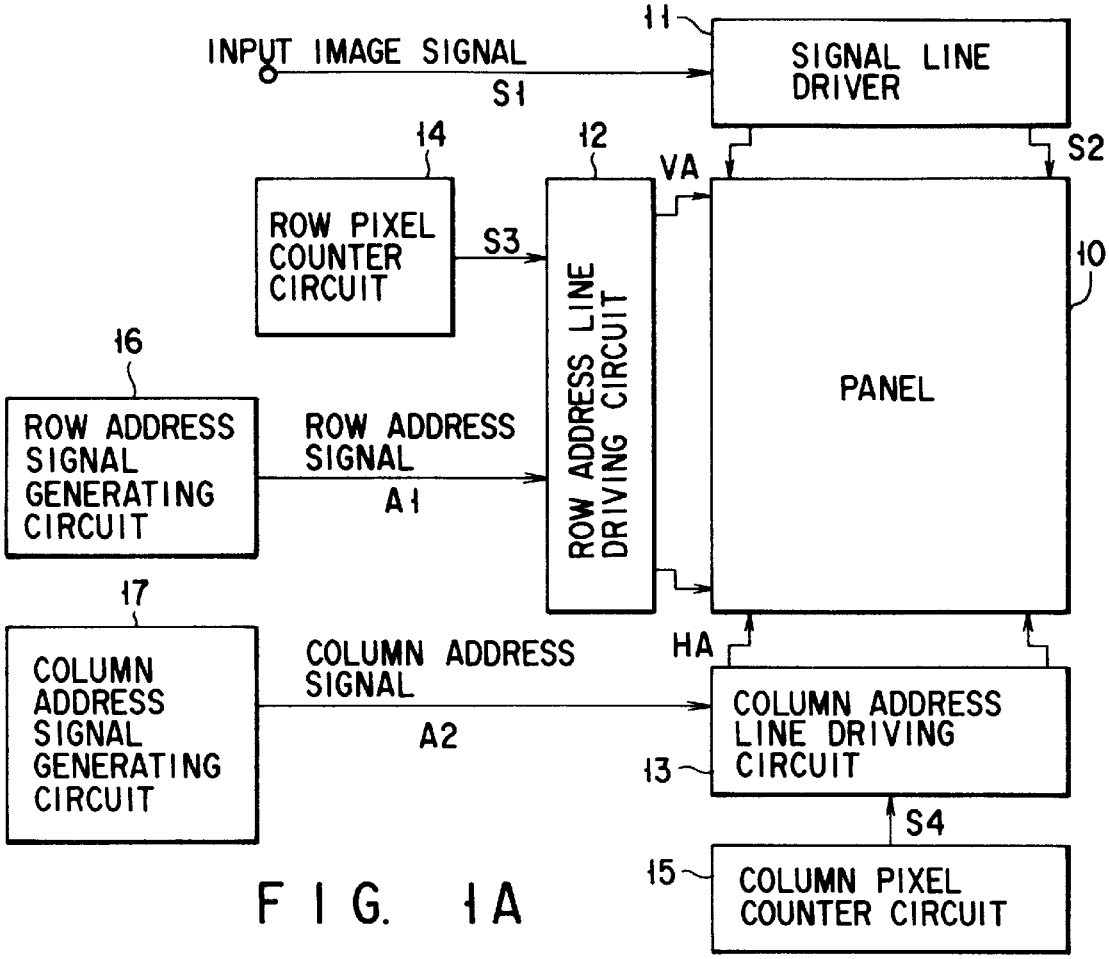
FIGS. 1A and 1B are views showing the configuration of the main components of a liquid crystal display according to a first embodiment of the present invention and the cell construction of a liquid crystal panel of the display, respectively.

FIG. 1A is a view showing the configuration of the major components of a liquid crystal display according to the first embodiment of the present invention. The liquid crystal display of this embodiment comprises a liquid crystal display panel 10 having a pixel matrix consisting of a plurality of pixels, a signal line driver 11, a row address line driving circuit 12, a row pixel counter circuit 14, a row address signal generating circuit 16, a column address line driving circuit 13, a column pixel counter circuit 15, and a column address signal generating circuit 17.

Figure 2A:
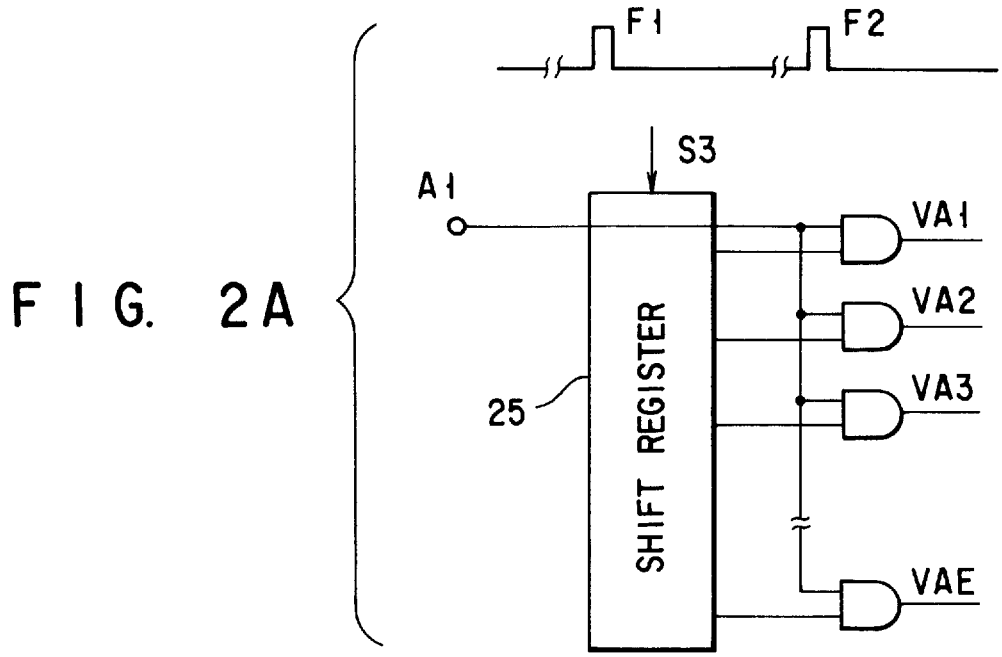
FIGS. 2A and 2B are views showing the signal processing manners of row and column address line driving circuits, respectively, of the display in FIG. 1A.

FIG. 2A shows the processing manner of the row address line driving circuit 12. The row pixel counter circuit 14 generates a start signal S3 whenever a time (usually one frame) required to drive all row address lines elapses. The row address signal generating circuit 16 generates a row address signal A1 for selectively scanning row address lines. The circuit 16 divides one frame (one frame image) into a plurality of subfields and scans only row address lines including pixels to be selected, such as in a multi-field driving method by which the driving frequency is lowered. Note that the multi-field driving method is a well-known technique and so a detailed description thereof will be omitted.

The row address line driving circuit 12 incorporates a shift register 25 and shifts the signal S3 row by row. Signals to row address lines VA1 to VAE are formed by ANDing the signal S3 shifted in the shift register 25 and a row address signal A1.

Figure 2B:
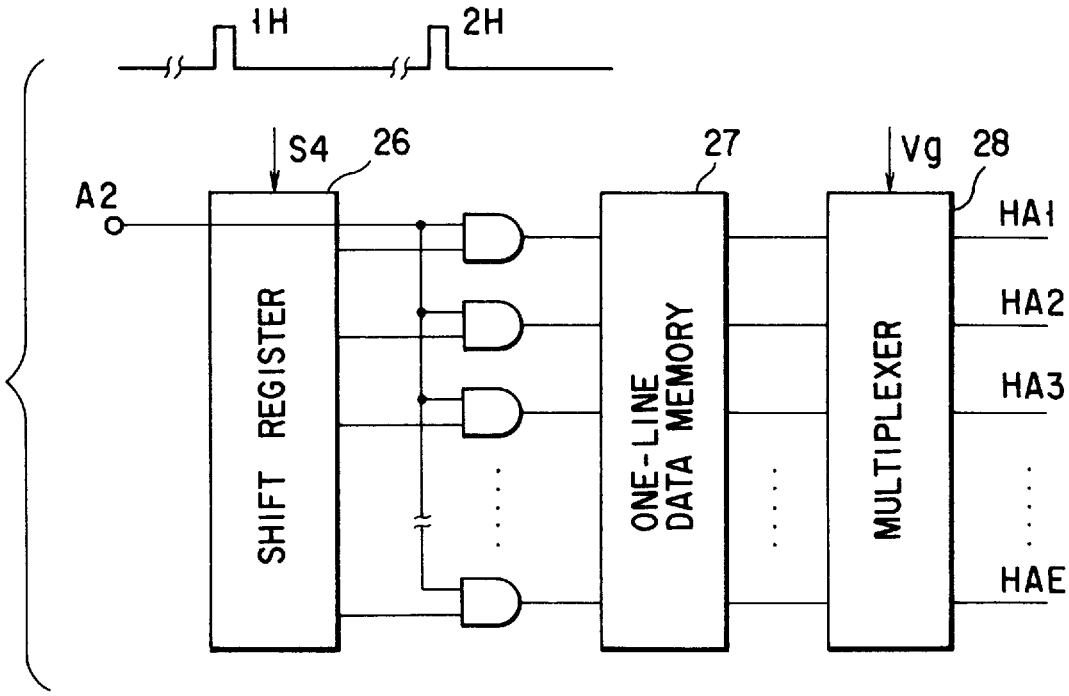

FIG. 2B shows the processing manner of the column address line driving circuit 13. The column pixel counter circuit 15 generates a start signal S4 whenever a time (usually one horizontal time) required to drive all column address lines elapses. The column address signal generating circuit 17 generates a column address signal A2 for selectively scanning column address lines. The circuit 17 can lower the driving frequency by dividing one horizontal image (an image of one horizontal line) into a plurality of subscreens. In this method, as is known in the multi-field driving method, it is preferable to compensate for flicker between adjacent pixels. For this purpose, the driving frequency can be optimized to fit a flickering image into a region which is not visually recognized by the visual property. It is also possible to randomly drive pixels to change the flicker frequency from one pixel to another, thereby distributing the flicker frequency so that the flicker is difficult to be visually recognized.

The column address line driving circuit 13 incorporates a shift register 26, a one-line data memory 27, and a multiplexer 28, and shifts the signal S4 column by column. The AND of the signal S4 shifted in the shift register 26 and the column address signal A2 is recorded in the one-line data memory 27. The data memory 27 records information for selecting a gate voltage output to column address lines HA1 to HAE. The multiplexer 28 controls the gate voltage output.

Figure 1B:
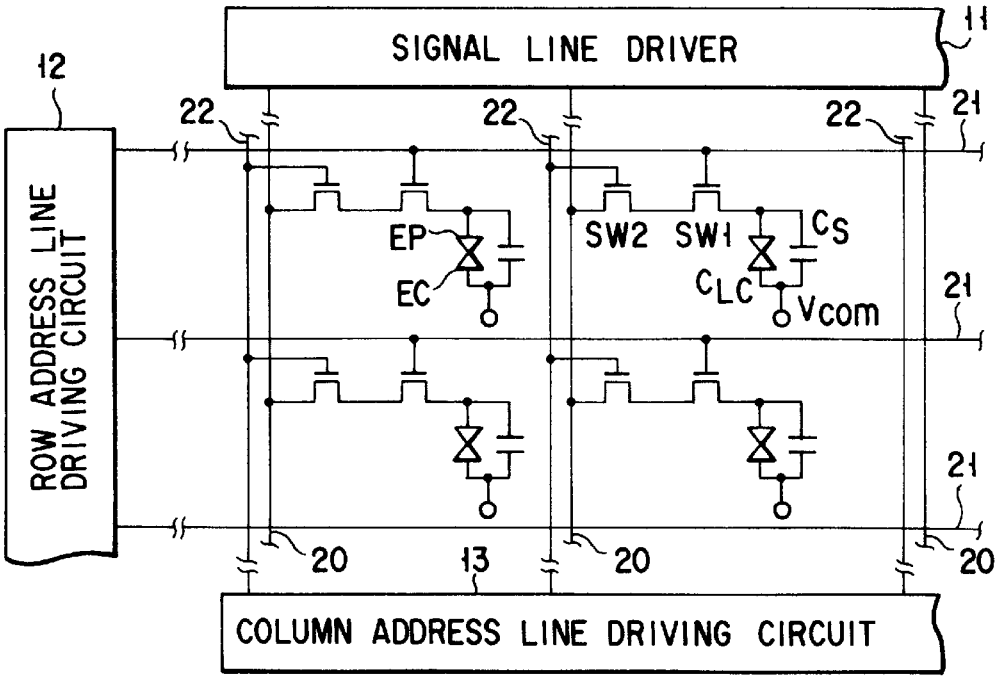

FIG. 1B shows the cell construction of the liquid crystal panel of the display of the first embodiment. A basic cell construction comprises a liquid crystal unit $C_{LC}$, a storage capacitor $C_S$, and a switching unit consisting of first and second switching devices SW1 and SW2. In the liquid crystal unit $C_{LC}$, a liquid crystal material is sandwiched between a pixel electrode EP and a counter electrode EC which opposes the pixel electrode EP. A common voltage Vcom is applied to the counter electrode EC. The storage capacitor $C_S$ is interposed between the pixel electrode EP and the counter electrode EC of the liquid crystal unit $C_{LC}$.

The switching devices SW1 and SW2 are first and second MOS transistors, respectively. The source, drain, and gate electrodes of the first MOS transistor SW1 are connected to the drain electrode of the second MOS transistor SW2, the pixel electrode, and a row address line 21, respectively. The source and gate electrodes of the second MOS transistor SW2 are connected to a signal line 20 and a column address line 22, respectively. When the transistors SW1 and SW2 at the intersection of the row address line 21 and the column address line 22, to which the gate voltages are applied, are simultaneously turned on, an image signal is supplied from the signal line 20 to the pixel electrode and written in the liquid crystal.

FIG. 3A shows the signal waveforms of the individual components. FIG. 3B shows the addresses of the individual pixels. FIGS. 3C and 3D illustrate the results when the pixels are switched by the signal waveforms in FIG. 3A. A pixel address Px,y (x and y are positive integers) indicates a pixel on row X and column Y. That is, X and Y correspond to a row address and a column address, respectively. The switching of each pixel is controlled by ANDing VA and HA.

(Second Embodiment)

In the second embodiment, as in the first embodiment described above, individual pixels present at the intersections of row address lines and column address lines are selectively driven. The configuration of the major parts of a liquid crystal display according to the second embodiment is the same as that shown in FIG. 1A.

Figure 4A:
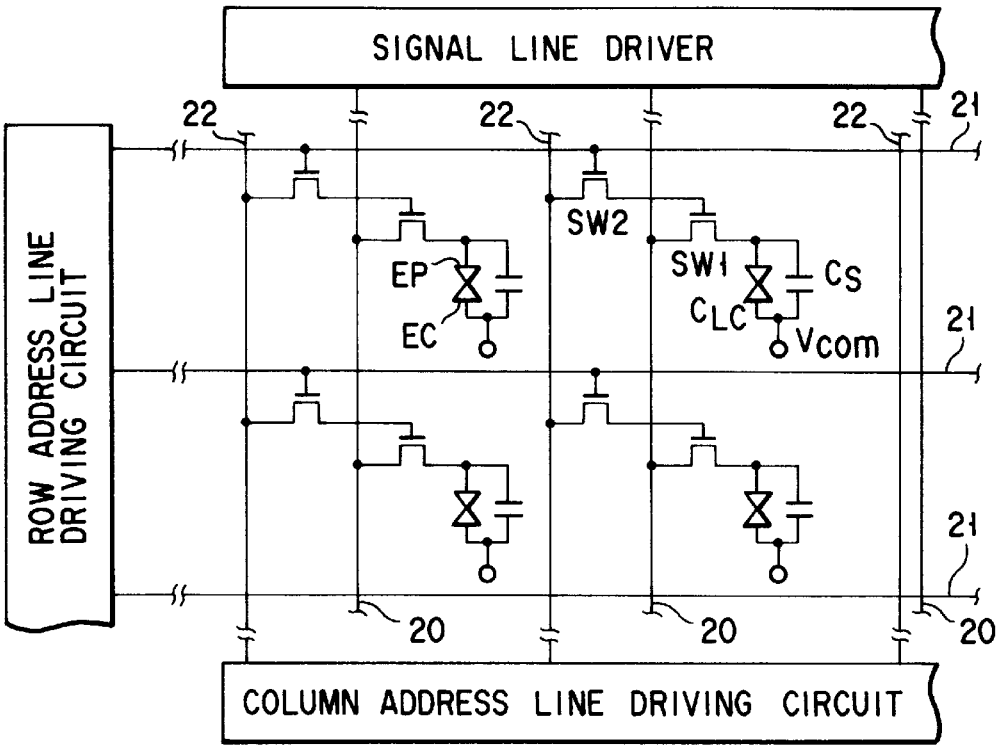
FIGS. 4A and 4B are views showing the cell construction of a liquid crystal panel of a liquid crystal display according to a second embodiment of the present invention and the signal processing manner of a column address line driving circuit of the display, respectively.

FIG. 4A shows the cell construction of a liquid crystal panel of the second embodiment. In this embodiment, a basic cell construction comprises a liquid crystal unit $C_{LC}$, a storage capacitor $C_S$, and a switching unit consisting of first and second switching devices SW1 and SW2. The switching devices SW1 and SW2 are first and second MOS transistors, respectively. The source and drain electrodes of the first MOS transistor SW1 are connected to a signal line 20 and a pixel electrode, respectively. The source and drain electrodes of the second MOS transistor SW2 are connected to a column address line 22 and the gate electrode of the first MOS transistor SW1, respectively. The gate electrode of the second MOS transistor SW2 is connected to a row address line 21. The gate voltage of the transistor SW1 is supplied by a column address signal, and the transistor SW1 is turned on and off by switching on and off the transistor SW2 by a row address signal. Therefore, the gate voltage of the transistor SW1 directly connected to the pixel can be varied for each pixel.

Figure 4B:
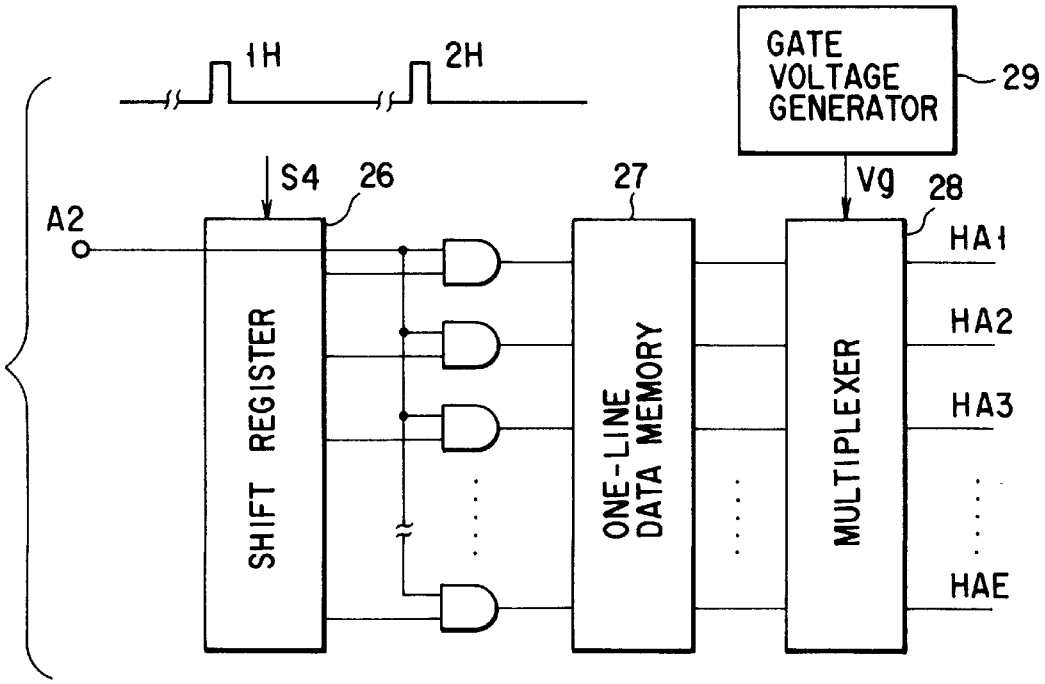

The processing manner of a column address line driving circuit 13 is, for example, as shown in FIG. 4B. Referring to FIG. 4B, a gate voltage generator 29 is additionally provided, and the switching characteristic of the transistor SW1 is controlled by the voltage generated by the generator 29.

Figure 5A:
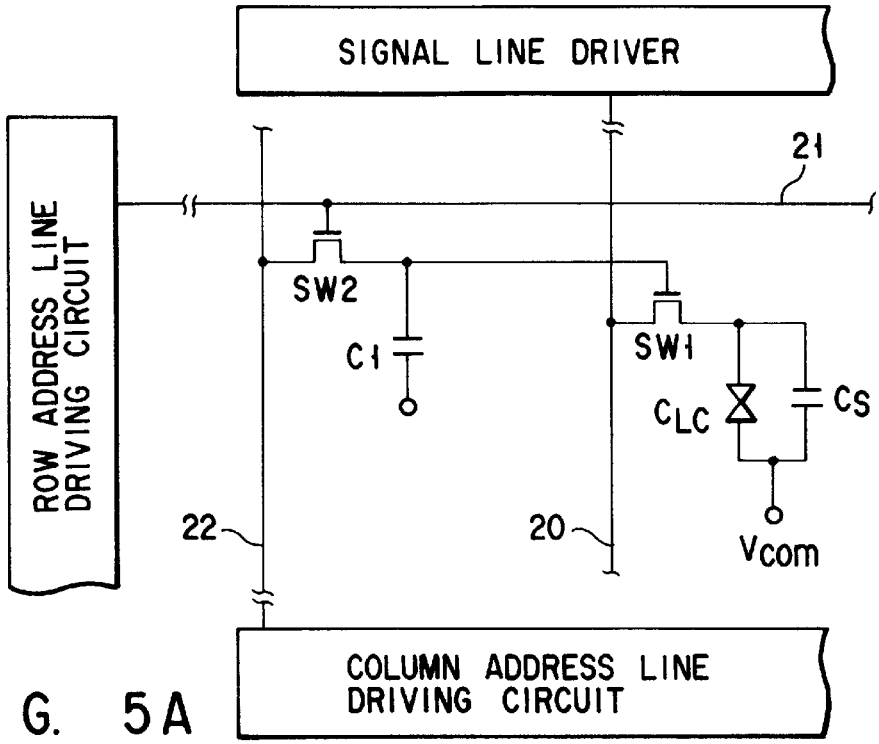
FIGS. 5A and 5B are views showing the cell constructions of two modifications of the second embodiment of the present invention.

FIG. 5A shows the construction of a cell in a modification of the second embodiment. In this modification, a line connecting the drain electrode of the second switching device SW2 to the gate electrode of the first switching device SW1 is connected to a portion for holding the gate voltage of the first switching device SW1, e.g., to ground, via a capacitor C1. Consequently, the potential of the gate voltage of the first switching device SW1 is stably maintained until it is changed by a new signal.

Figure 18:
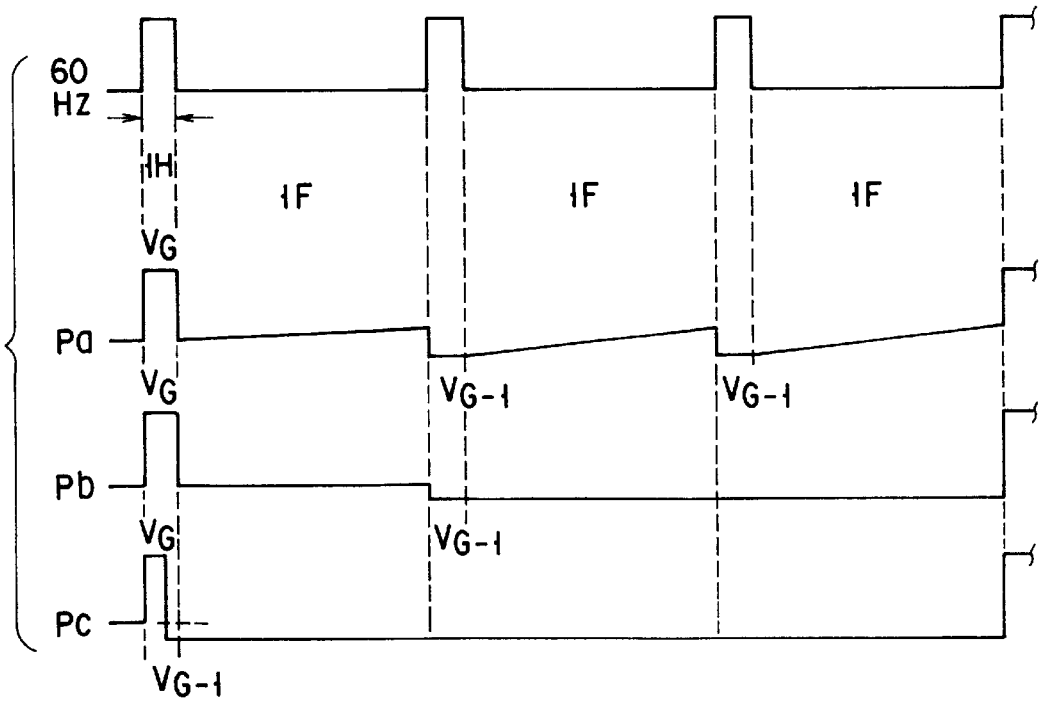
FIG. 18 is a view for explaining the advantage of the modification shown in FIG. 5A.

FIG. 18 is a view for explaining the advantage of the modification shown in FIG. 5A. In the cell construction shown in FIG. 4A, if a leak of the second switching device SW2 is large, the gate voltage of the first switching device SW1 is difficult to hold. In the cell construction in FIG. 4A, therefore, as indicated by a signal waveform Pa in FIG. 18, even during the holding period of a pixel, it is desirable to input a voltage $V_{G-1}$ for holding, each time the corresponding row address line is selected in the subsequent field, in order to maintain the holding state. In contrast, in the cell construction shown in FIG. 5A, during the holding period of a pixel, the gate voltage of the first switching device SW1 can be maintained at an optimum voltage by the action of the capacitor C1. Accordingly, the voltage $V_{G-1}$ for holding need not be input each time the corresponding address line is selected in the subsequent field, i.e., need only be input once after writing in a pixel. For example, as indicated by a signal waveform Pb in FIG. 18, the voltage $V_{G-1}$ can be input when the corresponding row address line is selected in a field (second field) following a pixel write field (first field). Alternatively, as indicated by a signal waveform Pc in FIG. 18, the voltage $V_{G-1}$ can be input in the same field as the pixel write field after a pixel write voltage $V_G$ is input.

Figure 5B:
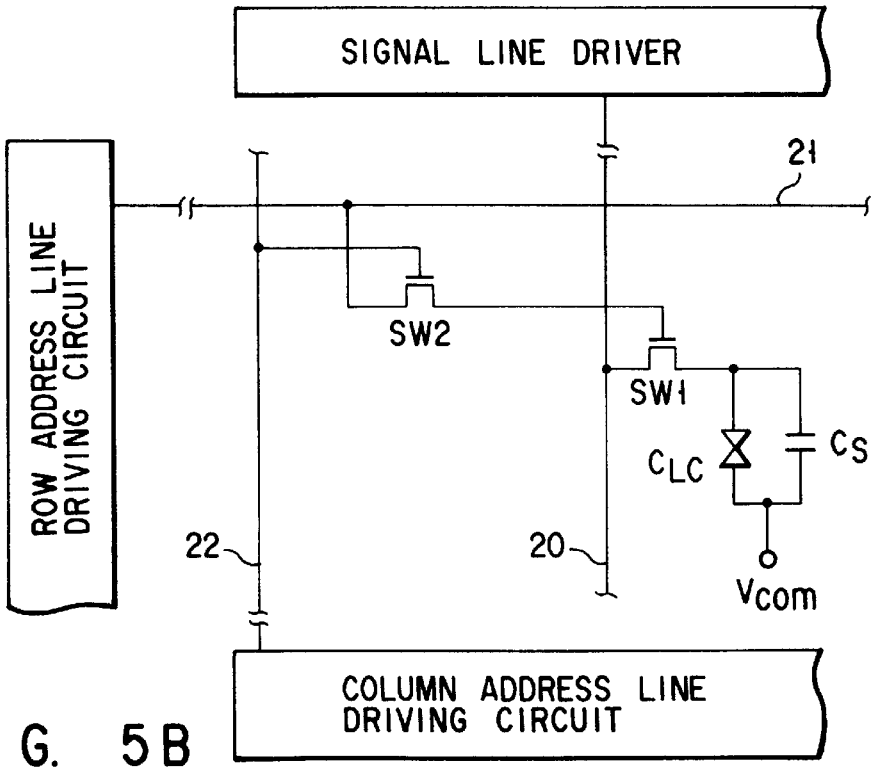

FIG. 5B shows the construction of a cell in another modification of the second embodiment. In this modification, the functions of the row address line and the column address line in the construction shown in FIG. 4A are interchanged. That is, the gate voltage of the transistor SW1 is supplied by a row address signal and turned on and off by switching on and off the transistor SW2 by a column address signal.

(Third Embodiment)

In the third embodiment, a timing at which the gate voltages are supplied to a row address line and a column address line is changed from one pixel to another. In addition, the driving frequency is changed from one pixel to another.

Figure 6:
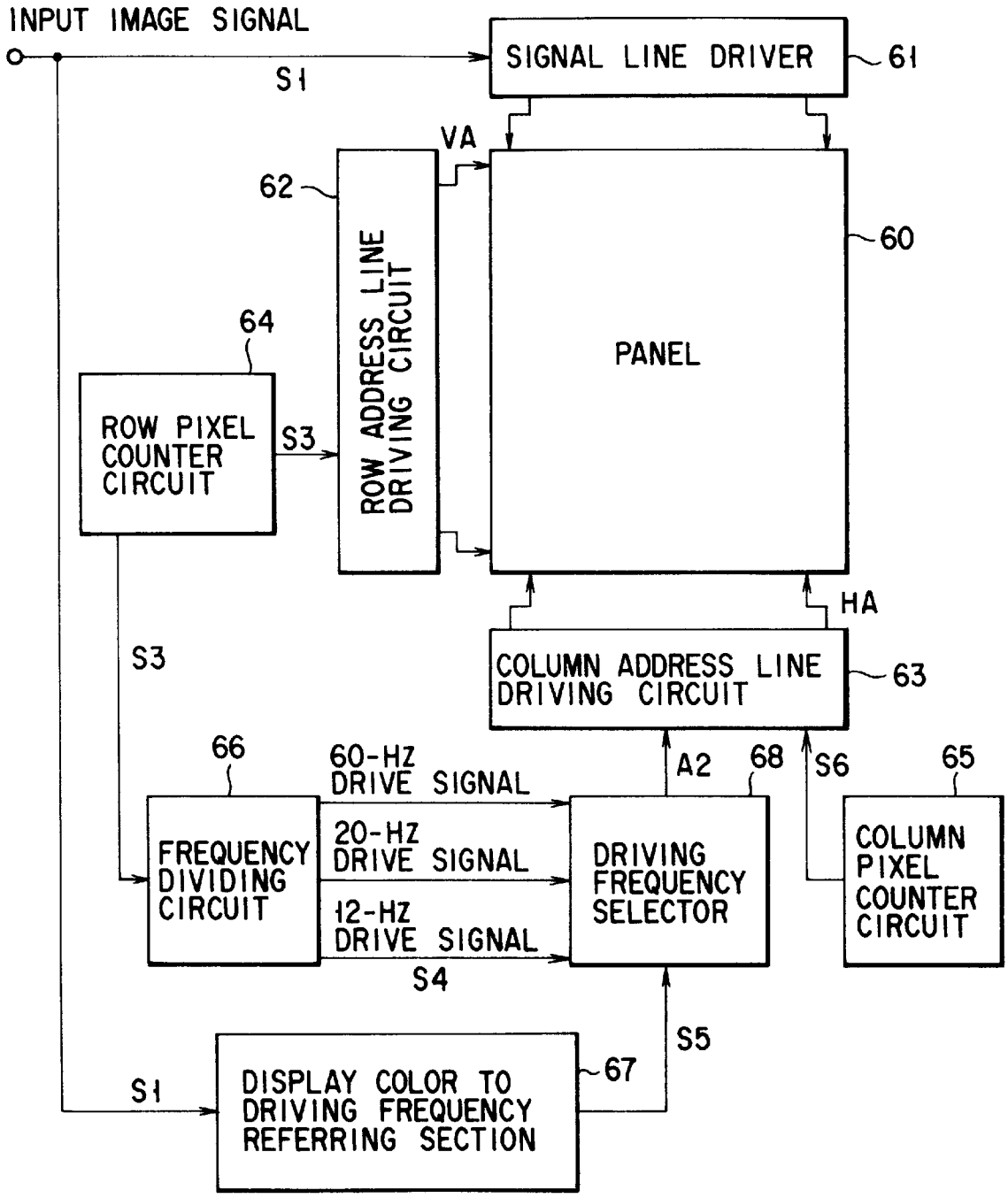
FIG. 6 is a view showing the configuration of the major components of a liquid crystal display according to a third embodiment of the present invention.

FIG. 6 shows the configuration of the major parts of a liquid crystal display according to the third embodiment, in which the driving frequency is changed in accordance with the display color. As in FIG. 6, the liquid crystal display of this embodiment comprises a liquid crystal display panel 60 having a pixel matrix, a signal line driver 61, a row address line driving circuit 62, a row pixel counter circuit 64, a frequency dividing circuit 66, a display color to driving frequency referring section 67, a driving frequency selector 68, a column address line driving circuit 63, and a column pixel counter circuit 65.

Figure 7A:
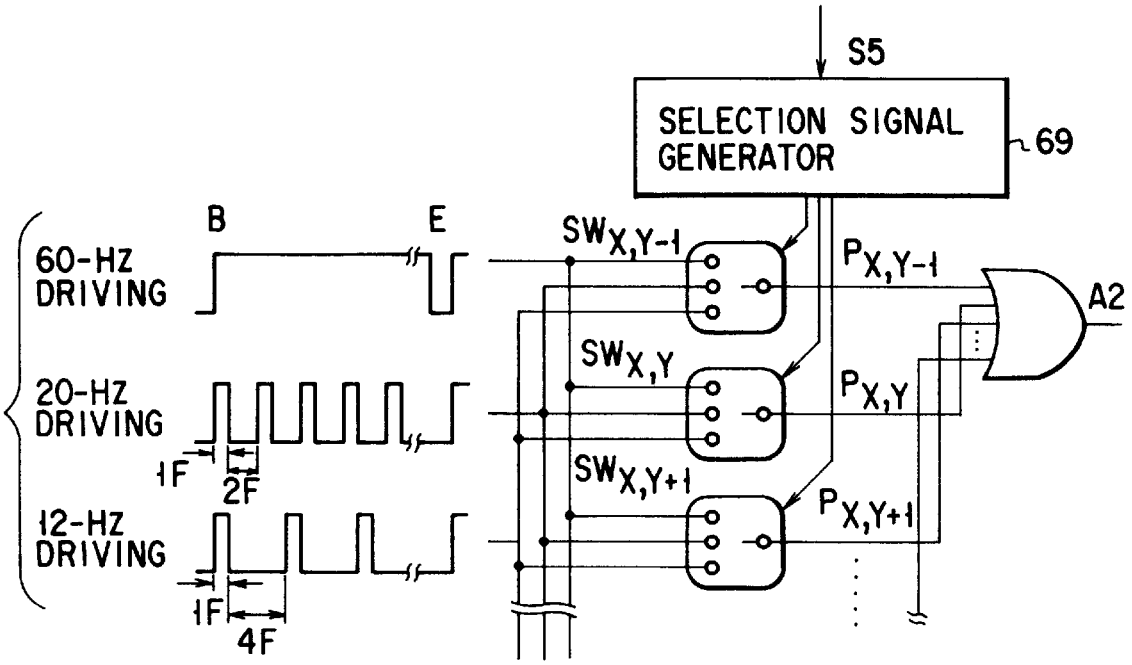
FIGS. 7A and 7B are views showing the processing manner of a driving frequency selector and the signal waveforms of the individual components in the display shown in FIG. 6, respectively.

In this embodiment, a one-frame start pulse signal S3 generated by the row pixel counter circuit 64 is converted into a signal having a non-selection period by the frequency dividing circuit 66. For example, to perform 60-Hz driving (normal driving), the frequency dividing circuit 66 counts pulses S3 and constantly outputs "H" while pulses S3 are input. To perform 20-Hz driving (⅓ frequency-division driving), the frequency dividing circuit 66 outputs "H" after the first pulse S3 and outputs "L" after the second and third pulses S3. To perform 12-Hz driving (⅕ frequency-division driving), the frequency dividing circuit 66 outputs "H" after the first pulse S3 and outputs "L" after the second to fifth pulses S3. The frequency dividing circuit 66 repeats the processing for every three periods (three pulses S3) in the 20-Hz driving and for every five periods (five pulses S3) in the 12-Hz driving. Subsequently, the driving frequency corresponding to the display color is selected for each pixel by turning on or off a switching device SWx,y. That is, in the 20-Hz driving, the first frame is a selection period and the subsequent two frames form a non-selection period. In the 12-Hz driving, the first frame is a selection period and the subsequent four frames form a non-selection period. FIG. 7A shows the signal waveforms and the processing manner of the driving frequency selector 68.

The display color to driving frequency referring section 67 performs select processing by which the driving frequency is determined in accordance with the input image. This processing manner is not particularly limited provided that the contents of the selection processing do not degrade the image quality. For example, in accordance with the flicker amount determined by the display color (usually luminance) and the holding characteristic of a pixel, 60-Hz driving (high-rate driving) is performed for a display color which readily causes flicker, and 12-Hz driving (low-rate driving) is performed for a display color which does not cause flicker easily. Commonly, flicker readily occurs when the luminance is around 50% because the luminance largely changes with a change in the electrode potential of a pixel. Accordingly, when the luminance is around 50%, it is desirable to perform high-rate driving to thereby shorten the holding period.

Figure 7B:
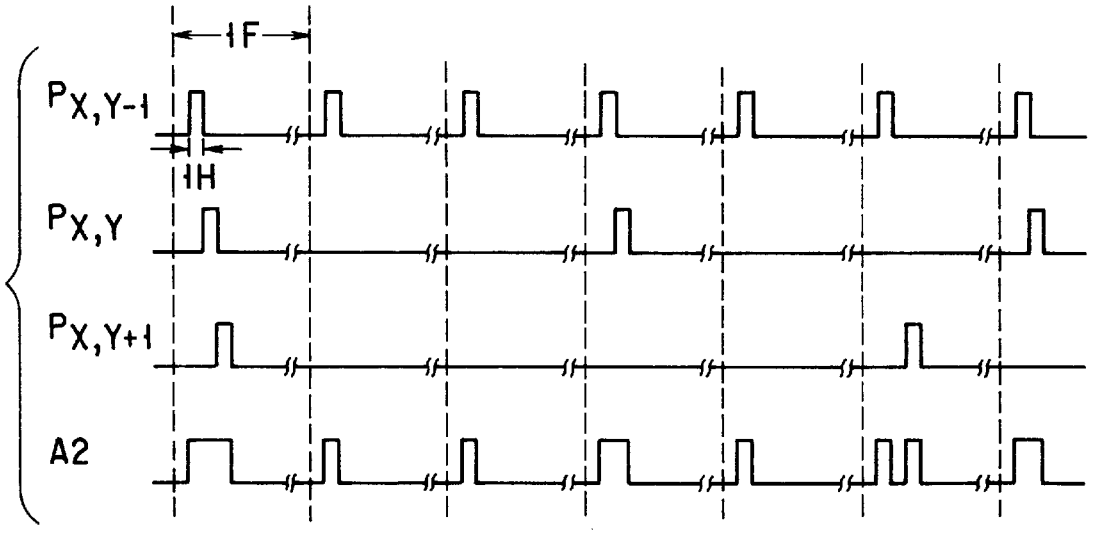

The processing result of the display color to driving frequency referring section 67 is applied to the driving frequency selector 68. As illustrated in FIG. 7A, as the processing contents of the driving frequency selector 68, it is necessary to output the result of selection of the driving frequency for each pixel in the horizontal direction. Therefore, a selection signal generator 69 sequentially manipulates SWx,y on the basis of the information of S5. For example, FIG. 7B shows signal waveforms when 60-Hz driving is performed in a pixel Px,y−1, 20-Hz driving is performed in a pixel Px,y, and 12-Hz driving is performed in a pixel Px,y+1. The OR of these signal waveforms is a column address signal A2.

Figure 8:
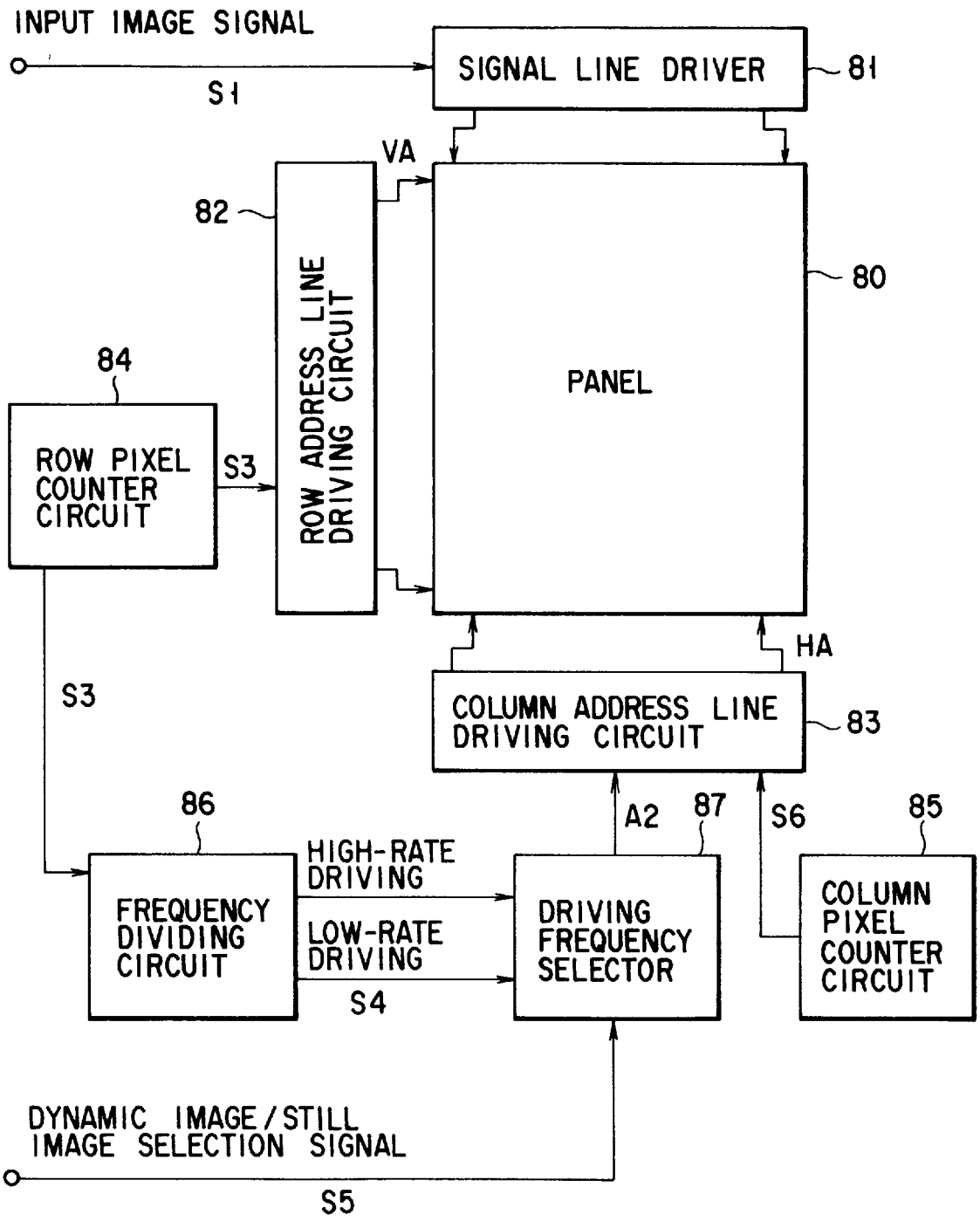
FIG. 8 is a view showing the configuration of the major parts of a modification when the third embodiment of the present invention is applied to selective driving of dynamic and still images.

FIG. 8 is a view showing the configuration of the main parts of a modification of the third embodiment. This modification eliminates the problem that when the overall display rate is decreased in a display image consisting of both dynamic and still images, an image-lag phenomenon occurs due to a lowering of the driving frequency of the dynamic image.

Figure 15A:
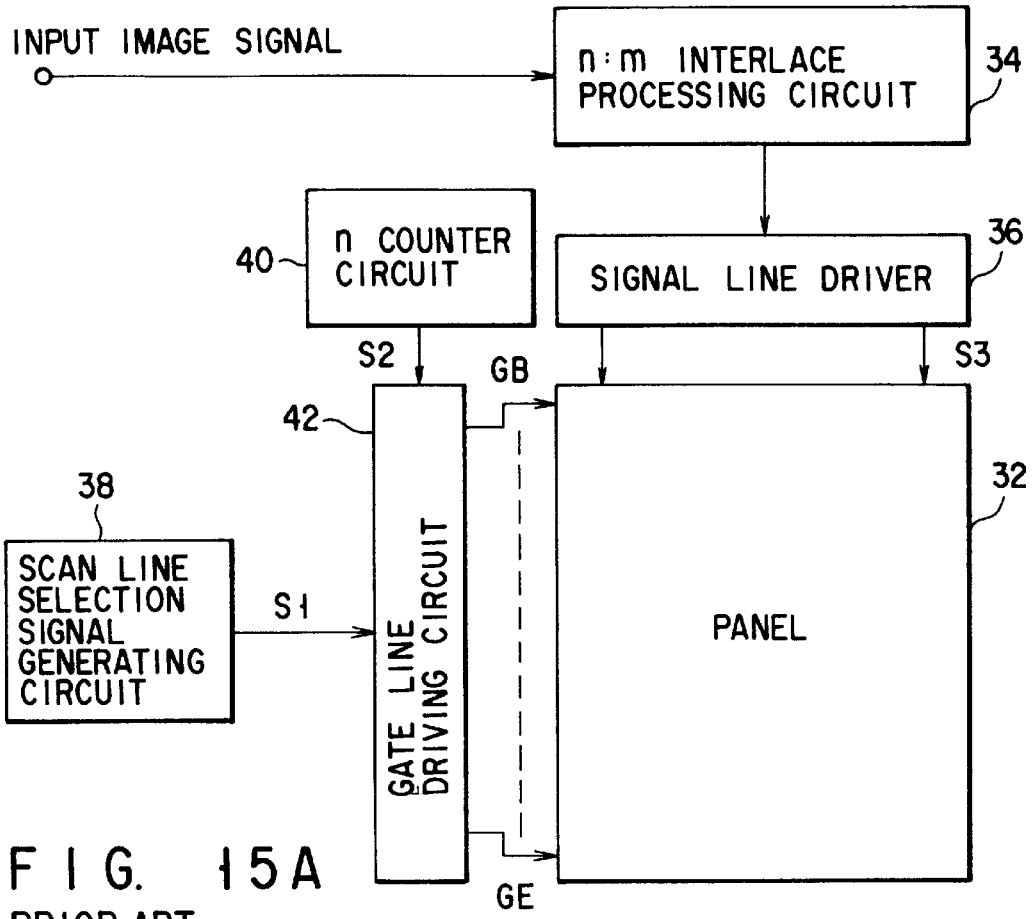
FIG. 15A PRIOR ART
FIGS. 15A and 15B are views showing the configuration of the major parts of a liquid crystal display according to conventional multi-field driving and the cell construction of a liquid crystal panel of the display, respectively.

First, an image-lag phenomenon occurring when multi-field driving is used in a conventional liquid crystal display will be described. FIG. 15A shows the configuration of the major components of a liquid crystal display when conventional multi-field driving, n=3 and m=1 (the number of subfields is 3−1=3), is used. This liquid crystal display comprises a liquid crystal display panel 32 having a pixel matrix, an n:m interlace processing circuit 34, a signal line driver 36, a scan line selection signal generating circuit 38, an n counter circuit 40, and a gate line driving circuit 42.

Figure 15B:
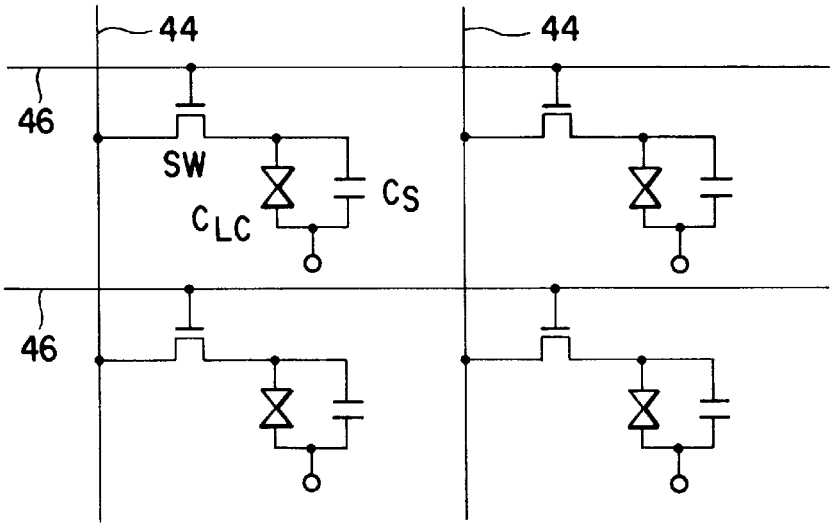
FIG. 15B PRIOR ART

FIG. 15B shows the cell construction of this conventional liquid crystal panel. A basic cell construction comprises a liquid crystal unit $C_{LC}$, a storage capacitor $C_S$, and a switching device SW which is a MOS transistor. The source, drain, and gate electrodes of the MOS transistor SW are connected to a signal line 44, a pixel electrode, and a gate line 46, respectively.

Figure 16A:
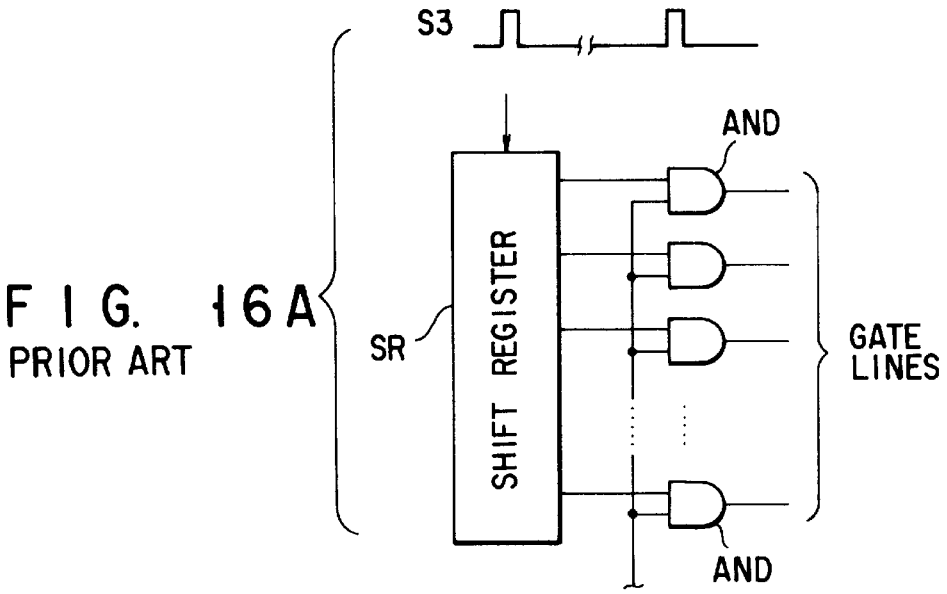
FIG. 16A PRIOR ART
FIGS. 16A and 16B are views showing the signal processing manner of a gate line driving circuit and the signal waveforms of the individual components, respectively, of the display in FIG. 15A.
Figure 16B:
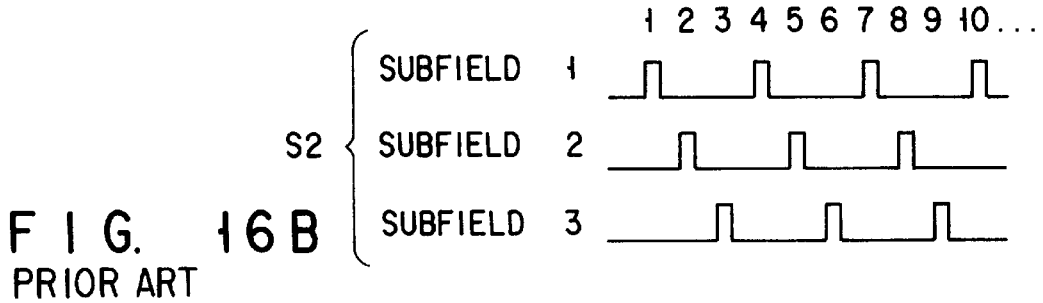
FIG. 16B PRIOR ART
Figure 17A:
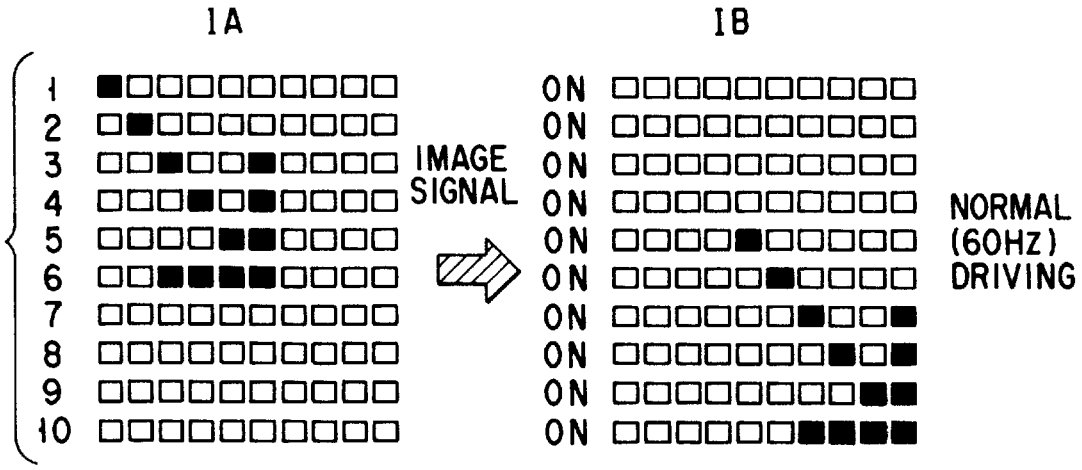
FIGS. 17A to 17C are views showing an image-lag phenomenon when a dynamic image is displayed by using the driving method in FIG. 15A and the effect when the driving method according to the present invention is used.
Figure 17B:
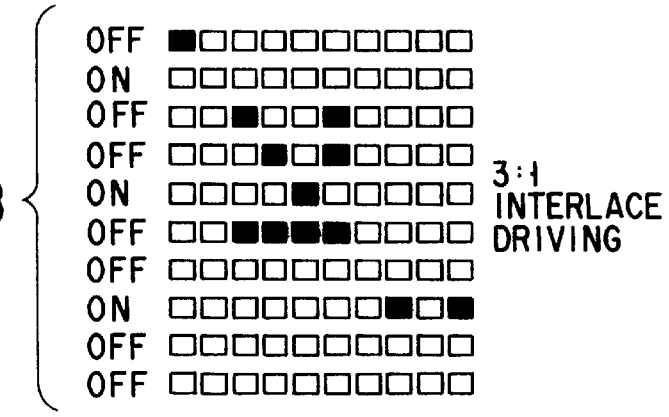
FIG. 17B PRIOR ART
Figure 17C:
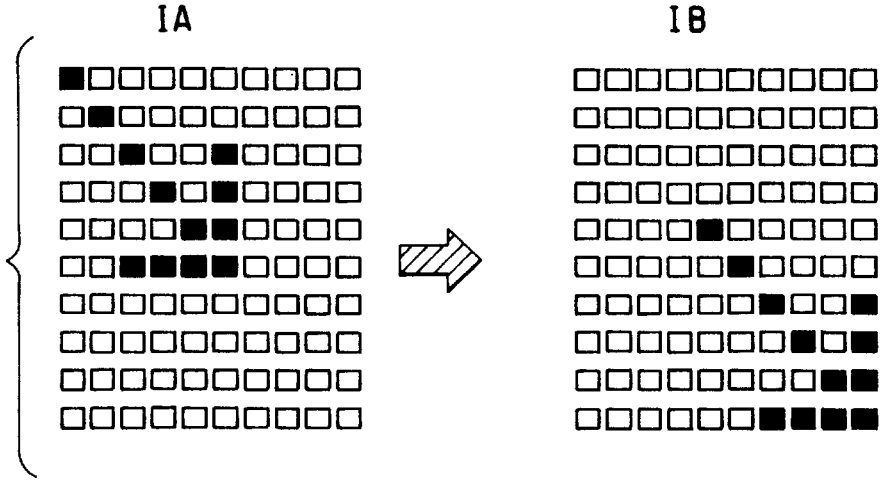

FIGS. 16A and 16B illustrate the processing manner performed by the gate line driving circuit. In first, second, and third subfields, gate lines 1, 4, 7, . . . , gate lines 2, 5, 8, . . . , and gate lines 3, 6, 9, . . . , are scanned, respectively. Assume, for example, that an image signal by which a demonstration image IA changes into a demonstration image IB, as illustrated in FIG. 17A, is supplied. When 3:1 interlace driving is performed, not only an image-lag phenomenon occurs but the image is not correctly displayed as in a display image illustrated in FIG. 17B. In contrast, in the present invention as shown in FIG. 17C, the image IA can be changed into the image IB since pixels whose image information has changed are scanned and pixels whose image information remains unchanged are not scanned. In other words, pixels to be rewritten and pixels not to be rewritten are distinguished from each other in units of a pixel. Accordingly, it is possible not only to display the image IB but also to reduce the power consumption for pixels whose image information remains unchanged.

The liquid crystal display shown in FIG. 8 comprises a liquid crystal display panel 80 having a pixel matrix, a signal line driver 81, a row address line driving circuit 82, a row pixel counter circuit 84, a frequency dividing circuit 86, a driving frequency selector 87, a column address line driving circuit 83, and a column pixel counter circuit 85.

As in FIG. 8, when a selection signal S5 indicating a dynamic image and a still image is externally applied, the driving frequency selector 87 selects high-rate driving for pixels which display the dynamic image and low-rate driving for pixels which display the still image.

Alternatively, a dynamic image/still image detecting circuit having one-frame memory can be used in place of the display color to driving frequency selector 68 in FIG. 6. Consequently, high-rate driving can be preferentially selected for a pixel whose image information in the preceding frame is different from that in the succeeding frame.

Figure 9A:
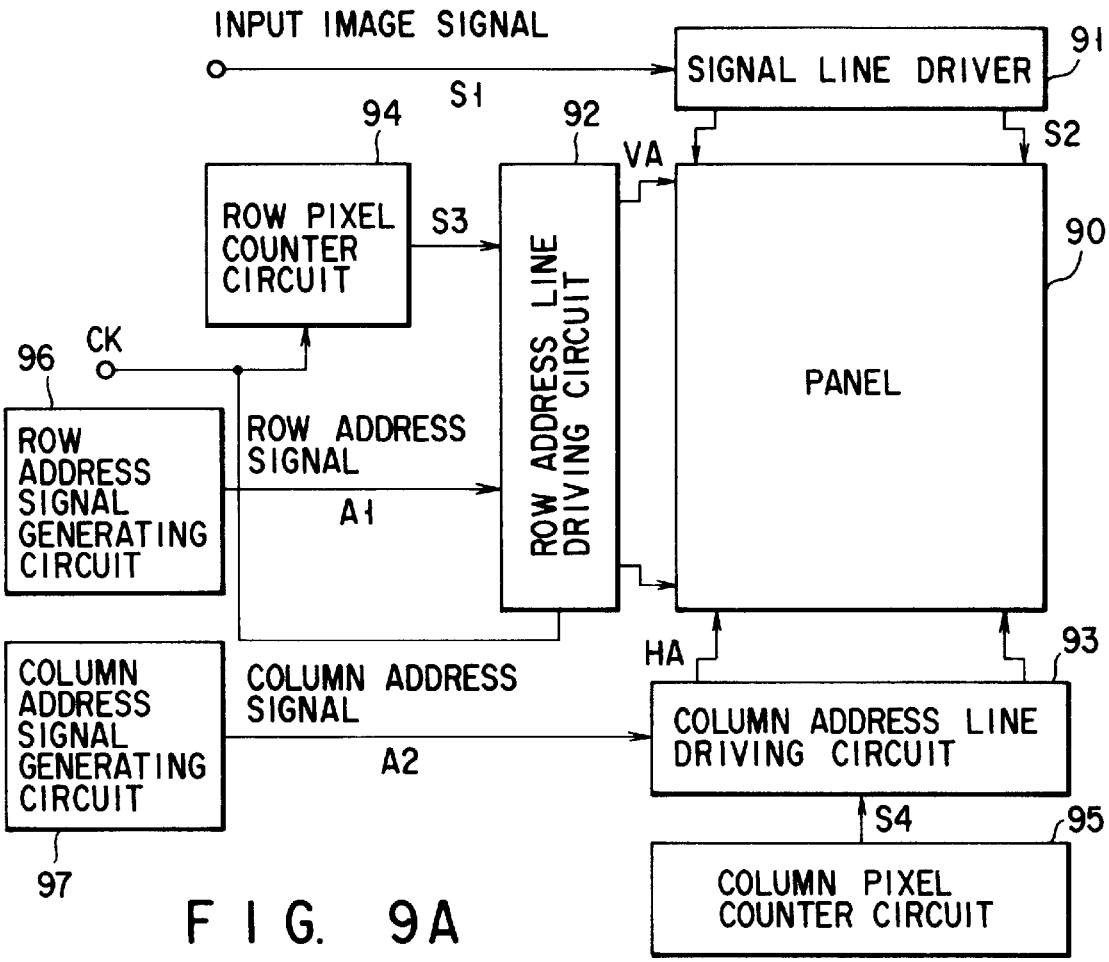
FIGS. 9A and 9B are views showing the configuration of the main components of a modification and the signal processing manner of a column address line driving circuit of the modification, respectively, when non-selection period shortening processing is performed in the third embodiment of the present invention.
Figure 9B:
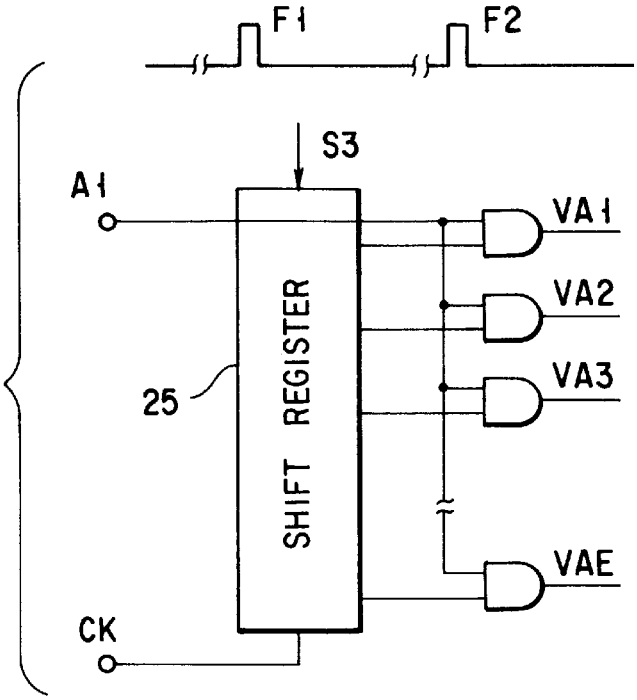

FIGS. 9A and 9B are views showing the configuration of the major components of another modification of the third embodiment and the signal processing manner of the modification, respectively. A liquid crystal display shown in FIG. 9A comprises a liquid crystal display panel 90 having a pixel matrix, a signal line driver 91, a row address line driving circuit 92, a row pixel counter circuit 94, a row address signal generating circuit 96, a column address line driving circuit 93, a column address signal generating circuit 97, and a column pixel counter circuit 95.

Figure 10A:
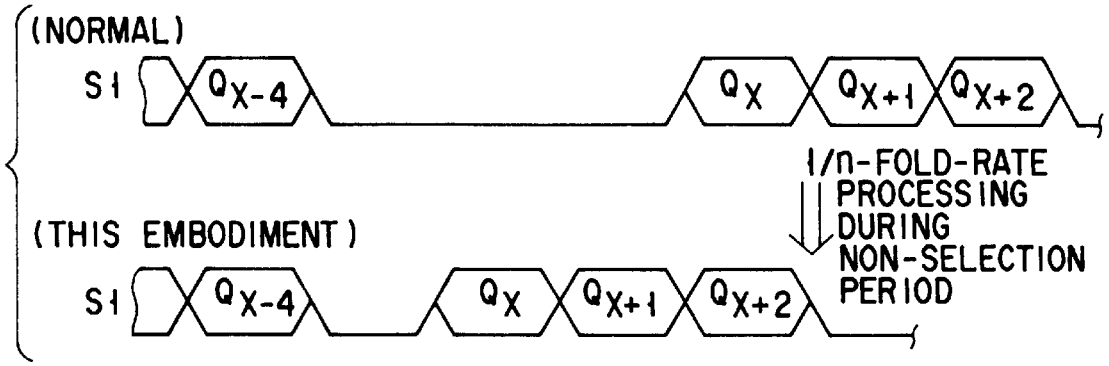
FIGS. 10A and 10B are views showing the signal waveforms of the individual components of the display shown in FIG. 9A.
Figure 10B:
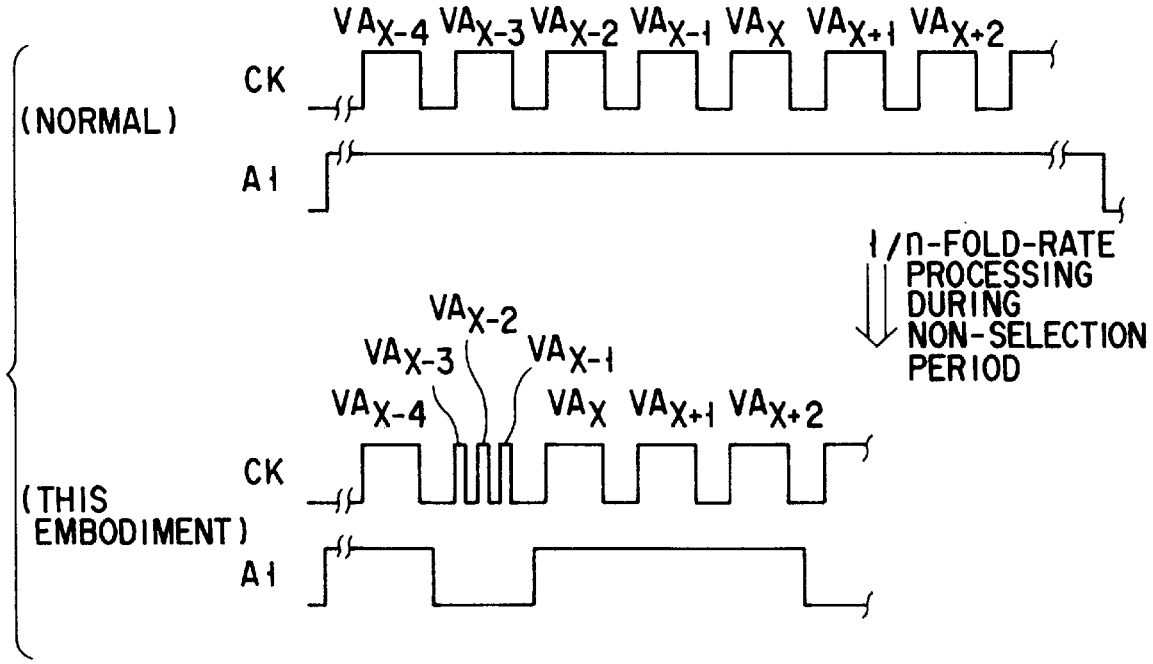

In the modification shown in FIG. 8, line sequential scan is performed for row address lines from the top. In the configuration shown in FIG. 9A, all pixels can be selectively scanned by inputting a row address signal. Therefore, for an address line having no pixels to be selected in the same row, the non-selection period described previously can be shortened by performing 1/n-fold-rate processing for an input image signal (FIG. 10A), a row address signal (FIG. 10B), or a column address signal (not shown). Consequently, since the non-selection period is shortened, the number of times a pixel is selected can be increased, and the driving frequency also can be increased to be higher than 60 Hz.

(Fourth Embodiment)

The fourth embodiment controls, in the liquid crystal display of the second embodiment in which the gate voltage of the first switching device SW1 directly connected to the pixel electrode can be changed by the column address line voltage, the writing characteristic and the holding characteristic of the pixel electrode by using the gate electrode of the switching device SW1.

Figure 11A:
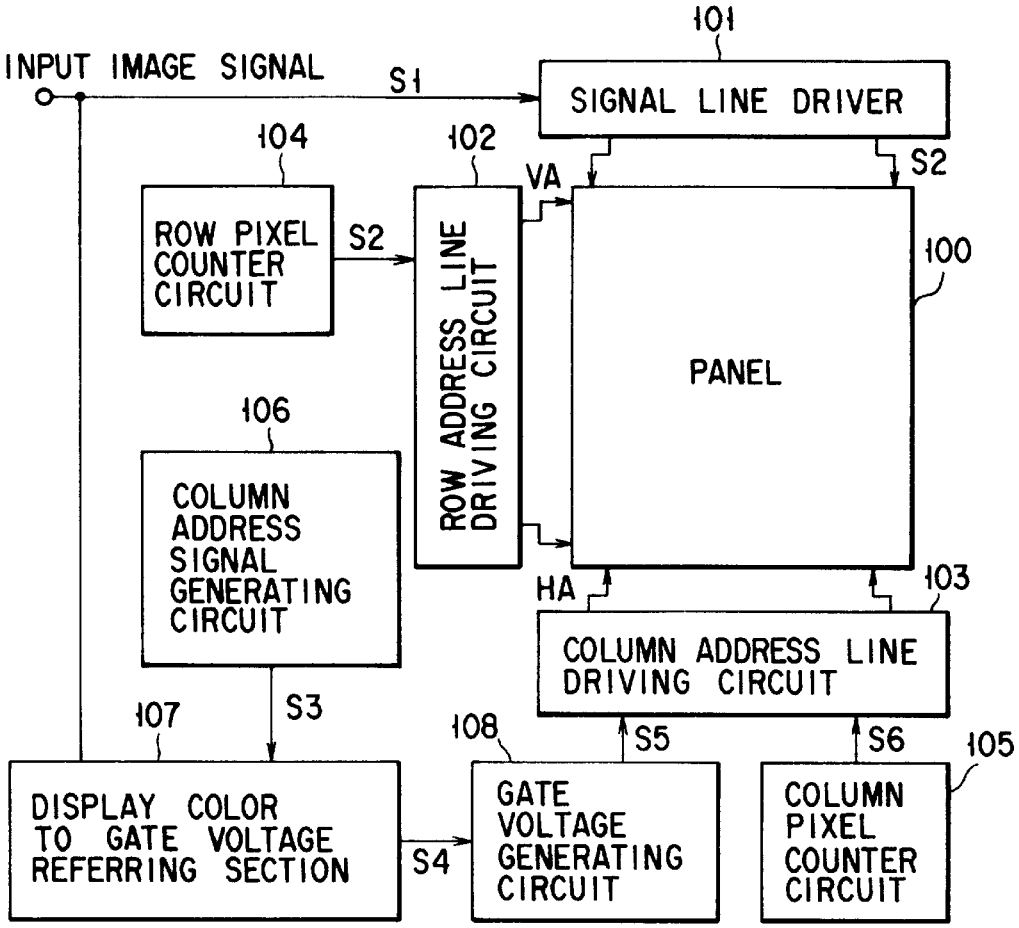
FIGS. 11A and 11B are views showing the configuration of the major parts of a liquid crystal display according to a fourth embodiment of the present invention and the signal waveforms of the individual components of the display, respectively.

FIG. 11A is a view showing the configuration of the main parts of a liquid crystal display according to the fourth embodiment of the present invention. The liquid crystal display of this embodiment comprises a liquid crystal display panel 100 having a pixel matrix, a signal line driver 101, a row address line driving circuit 102, a row pixel counter circuit 104, a column address line driving circuit 103, a column pixel counter circuit 105, a column address signal generating circuit 106, a display color to gate voltage referring section 107, and a gate voltage generating circuit 108.

Figure 11B:
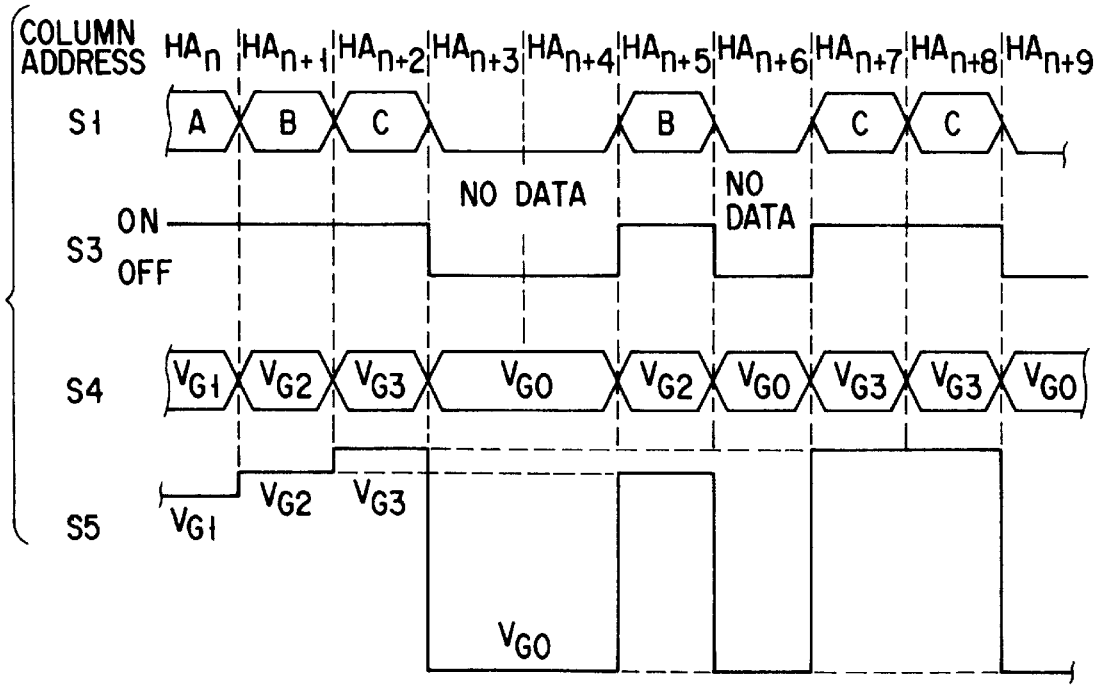

FIG. 11B shows the signal waveforms of the individual components of the display shown in FIG. 11A. To display colors A, B, and C, for example, the display color to gate voltage referring section applies appropriate gate voltage information $V_{G1}$, $V_{G2}$, and $V_{G3}$ to these display colors, thereby optimizing the writing characteristics. The voltage information is input as a signal S4 to the gate voltage generating circuit 108 which in turn applies to the column address line driving circuit 103 an analog signal S5 to be supplied to column address lines. The column address line driving circuit 103 includes a capacitor, for each address line, large enough to drive an address line. Voltage information $V_{G0}$ by which the switching device SW1 is not turned on is applied to a portion having no data. Alternatively, the voltage information $V_{G0}$ can be output when a signal S3 from the column address signal generating circuit 106 is OFF.

Figure 12A:
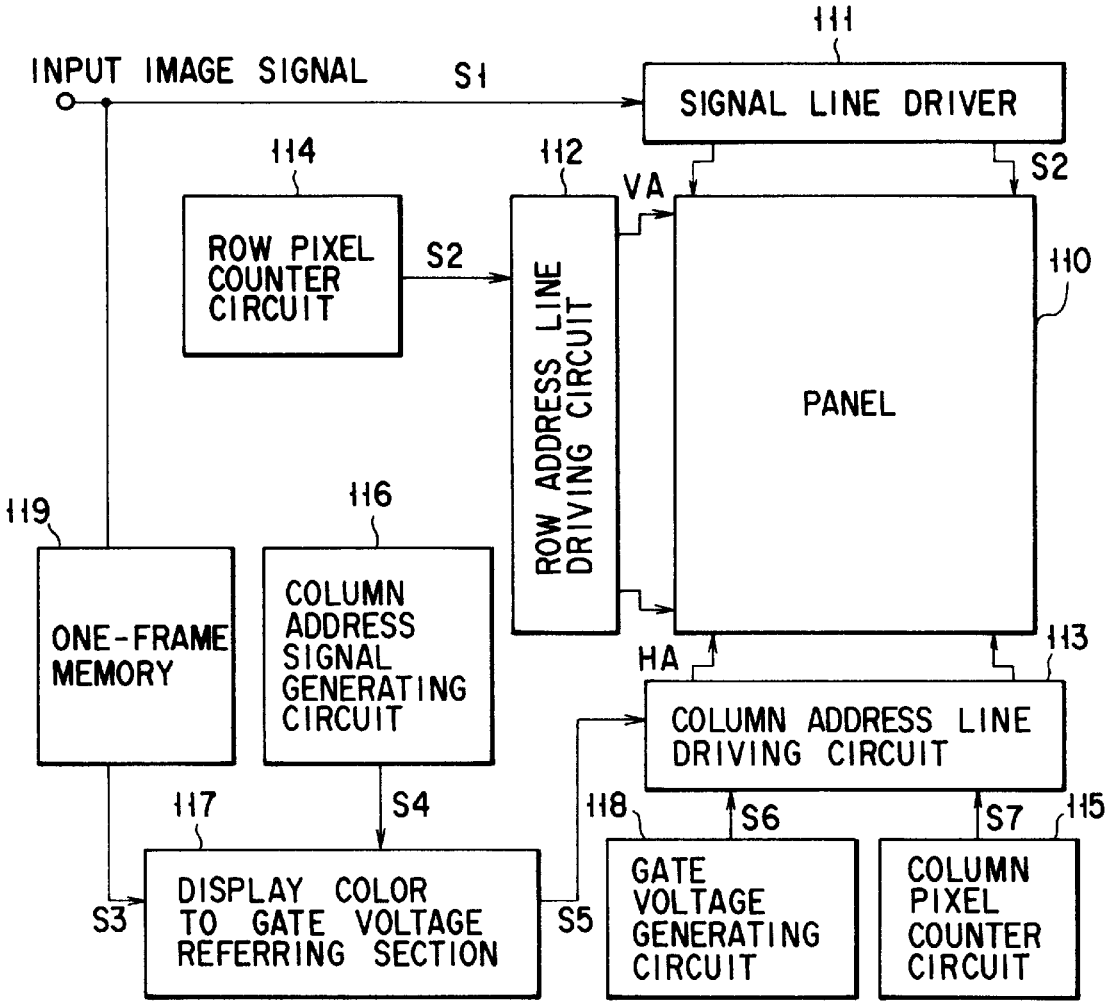
FIGS. 12A and 12B are views showing the configuration of the main parts and the signal processing manner, respectively, of a modification when the holding characteristic is improved in the fourth embodiment of the present invention.

FIG. 12A shows the configuration of the major parts of a modification of the fourth embodiment. A liquid crystal display of this modification comprises a liquid crystal display panel 110 having a pixel matrix, a signal line driver 111, a row address line driving circuit 112, a row pixel counter circuit 114, a column address line driving circuit 113, a column pixel counter circuit 115, a column address signal generating circuit 116, a display color to gate voltage referring section 117, a gate voltage generating circuit 118, and a one-frame memory 119.

Figure 12B:
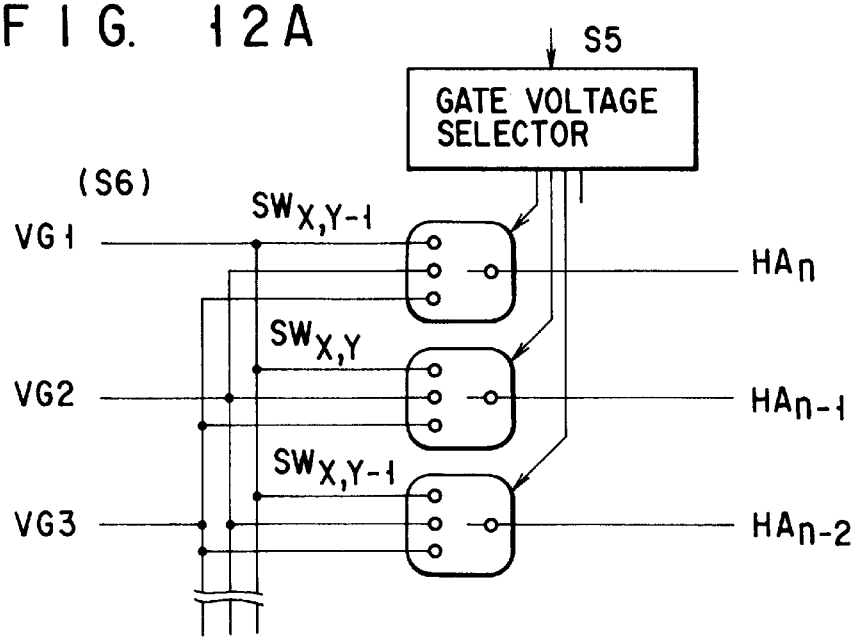

In the display shown in FIG. 11A, the column address line driving circuit 103 includes a capacitor for each address line. In the modification in FIG. 12A, as illustrated in FIG. 12B, the column address line driving circuit 113 has switching devices and selects the gate voltage in accordance with voltage information S5 from the display color to gate voltage referring section 117. Also, in FIG. 12A the gate voltage during the holding period is made variable to optimize the holding characteristic. In the holding period, the pixel information in the preceding frame is necessary. Therefore, the one-frame memory 119 stores the image information in the preceding frame and, instead of image information not to be rewritten, applies this stored information to the display color to gate voltage referring section 117. The display color to gate voltage referring section 117 obtains information of selection of an address line from a column address signal received from the column address line signal generating circuit 113.

Figure 13:
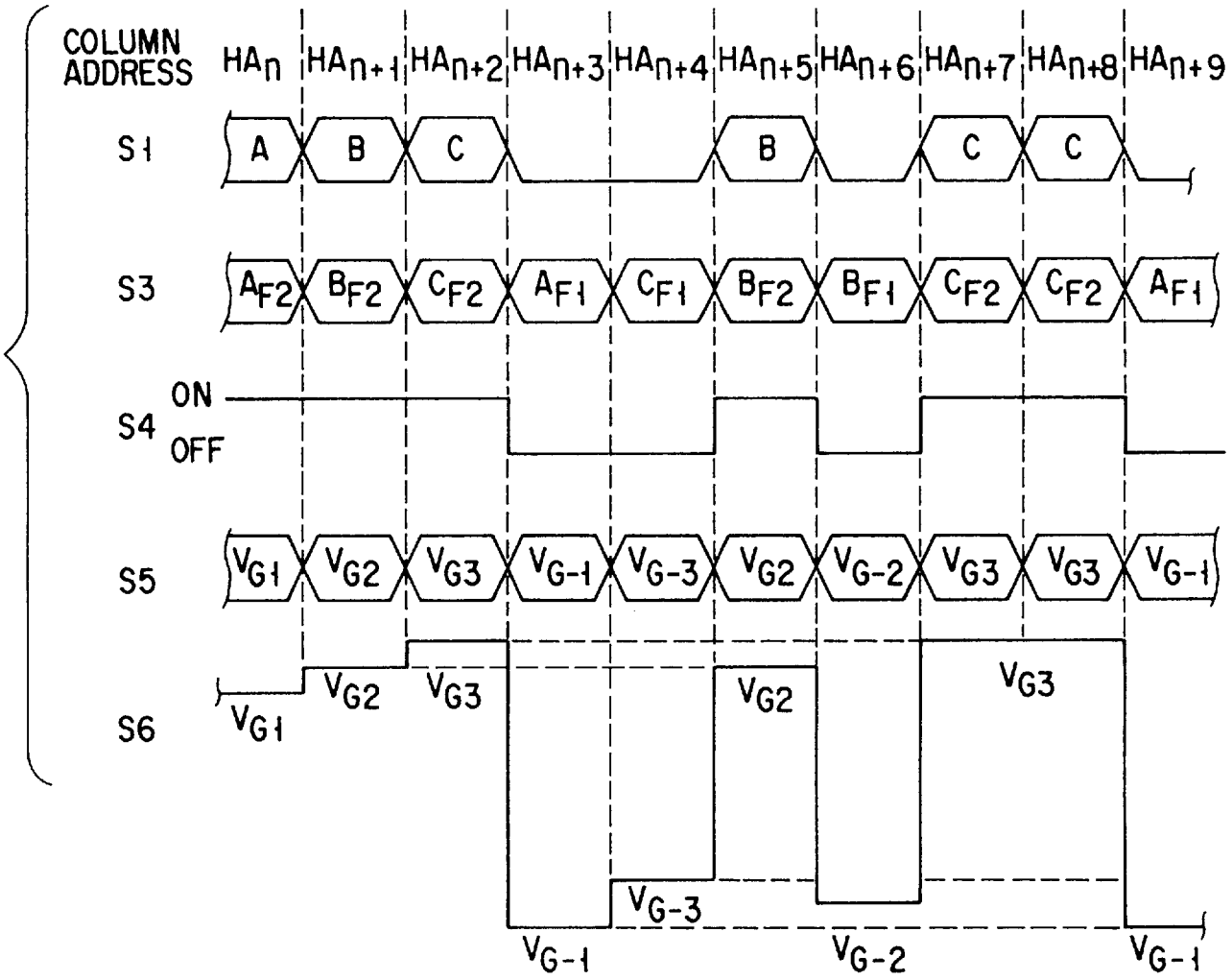
FIG. 13 is a view showing the signal waveforms of the individual components in the display shown in FIG. 12A.

FIG. 13 shows the signal waveforms of the individual components in the display shown in FIG. 12A. In the signal S3, to distinguish between preceding frame image information and succeeding frame image information, F1 (preceding frame image) and F2 (succeeding frame image) are appended as suffixes. However, these image information are not particularly different. For example, when the image information is A and the address line selection information is ON, $V_{G1}$ is output as the gate voltage information. When the image information is A and the address line selection information is OFF, $V_{G-1}$ is output as the gate voltage information. In accordance with this gate voltage information S5, the gate voltage is supplied to each column address line.

The method of selecting the gate voltage corresponding to the display color has a processing manner by which the image quality can be improved. The number of gate voltage levels which can be selected need not be the same as the number of display colors.

Figure 14:
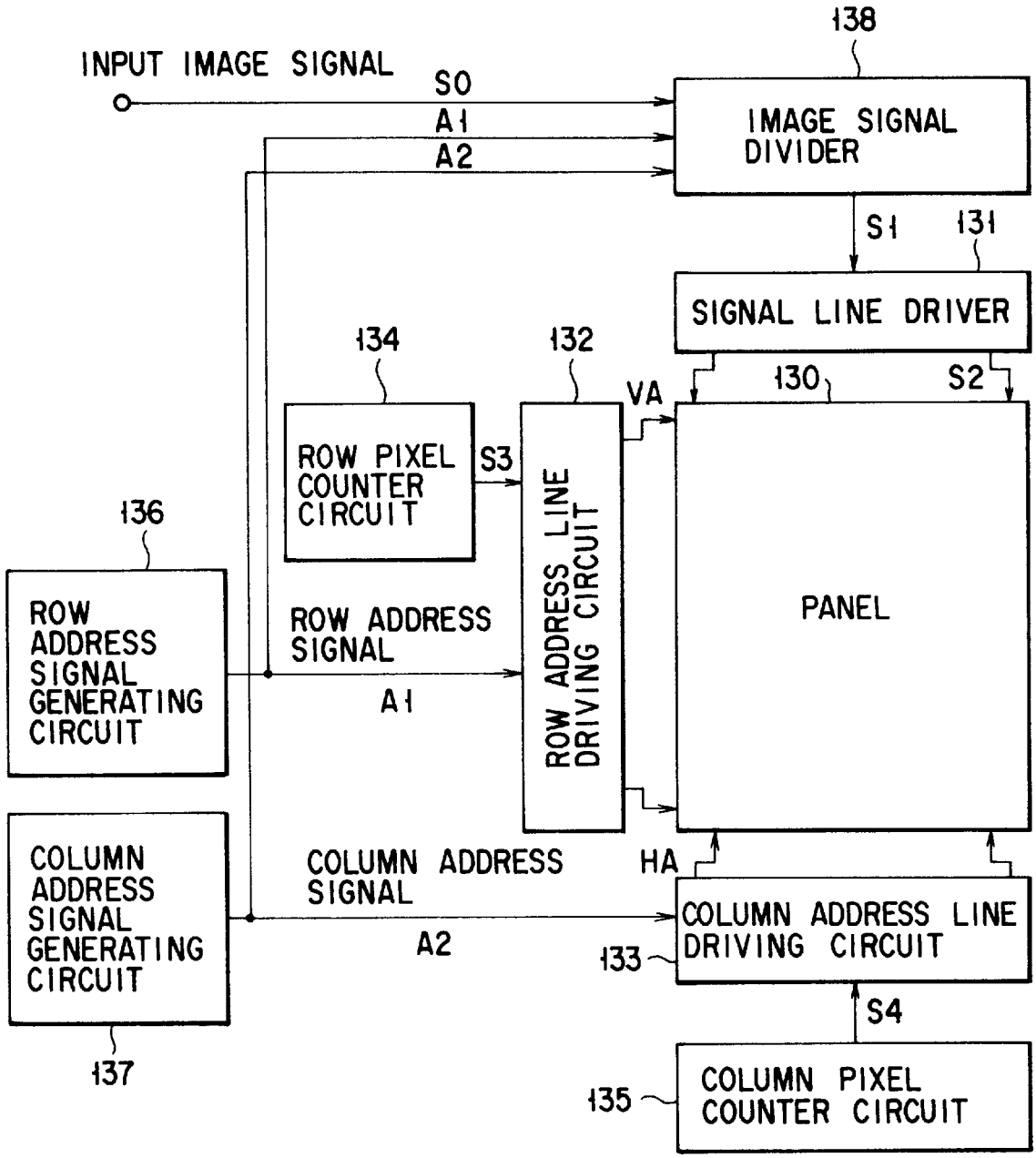
FIG. 14 is a view showing the configuration of the major components of a modification when an input image signal processing means is provided in the fourth embodiment of the present invention.

FIG. 14 is a view showing the configuration of the major components of another modification of the fourth embodiment. A liquid crystal display of this modification comprises a liquid crystal display panel 130 having a pixel matrix, a signal line driver 131, a row address line driving circuit 132, a row pixel counter circuit 134, a column address line driving circuit 133, a column pixel counter circuit 135, a row address signal generating circuit 136, a column address signal generating circuit 137, and an image signal divider 138.

In each of the embodiments and the modifications described above, only image information corresponding to a pixel to be selected is input as an input image. In the modification shown in FIG. 14, however, a row address signal A1, a column address signal A2, and an unprocessed image signal S0 are input to the image signal divider 138 and converted into an input image signal S1 corresponding to a pixel to be selected. The processing contents of the image signal divider 138 are not particularly limited. For example, the processing can be easily performed by ANDing the three signals.

The power consumption of each component (the signal line driver 131, the row address line driving circuit 132, the column address line driving circuit 133, and the panel) is reduced as the information is reduced, as is well known in the multi-field driving method.

In the embodiments shown in FIGS. 1A to 18, pixels arranged in columns can be selectively driven as well as those arranged in rows. This obviates the need for outputting a signal to each pixel which is not to be rewritten and thereby greatly reduces the power consumption.

Additionally, the driving frequency can be changed in accordance with the display color. Therefore, the driving frequency can be raised for a display color which is liable to flicker, and this prevents degradation of the image quality.

Also, the driving frequency can be changed in accordance with whether the display image is a dynamic image or a still image. Accordingly, the frequency can be raised for a dynamic image and lowered for a still image. This prevents degradation of the image quality caused by, e.g., an image-lag phenomenon.

Furthermore, the gate voltage of the switching device can be changed in accordance with the display color. As a consequence, it is possible to optimize the writing characteristic and the holding characteristic of the pixel electrode and thereby greatly improve the image quality.

(Fifth Embodiment)

In the fifth embodiment, the power consumption is reduced by selectively driving pixel blocks each consisting of a plurality of pixels in a liquid crystal display having a pixel matrix.

Figure 19A:
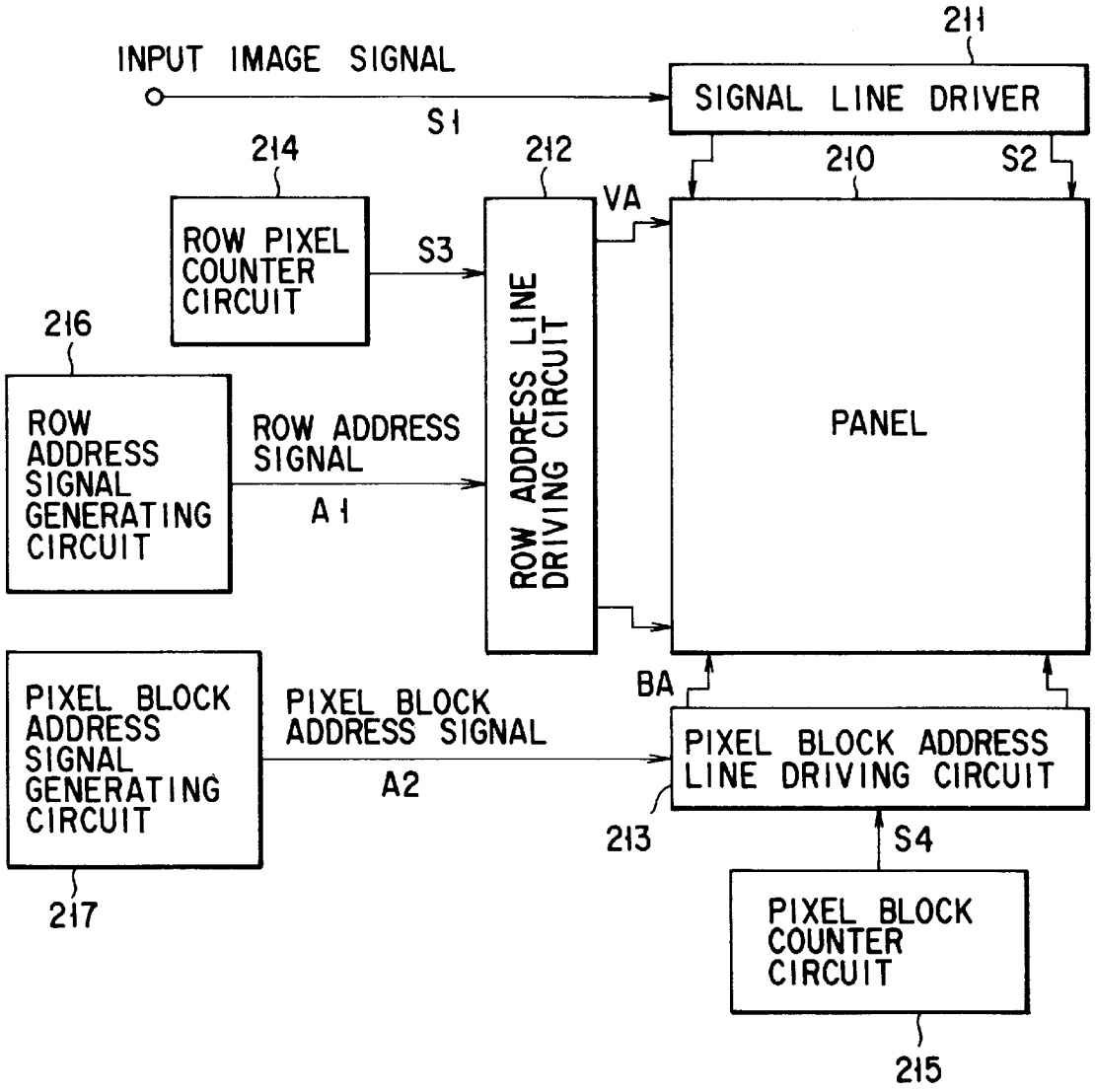
FIGS. 19A and 19B are views showing the configuration of the main components of a liquid crystal display according to a fifth embodiment of the present invention and the cell construction of a liquid crystal panel of the display, respectively.
Figure 19B:
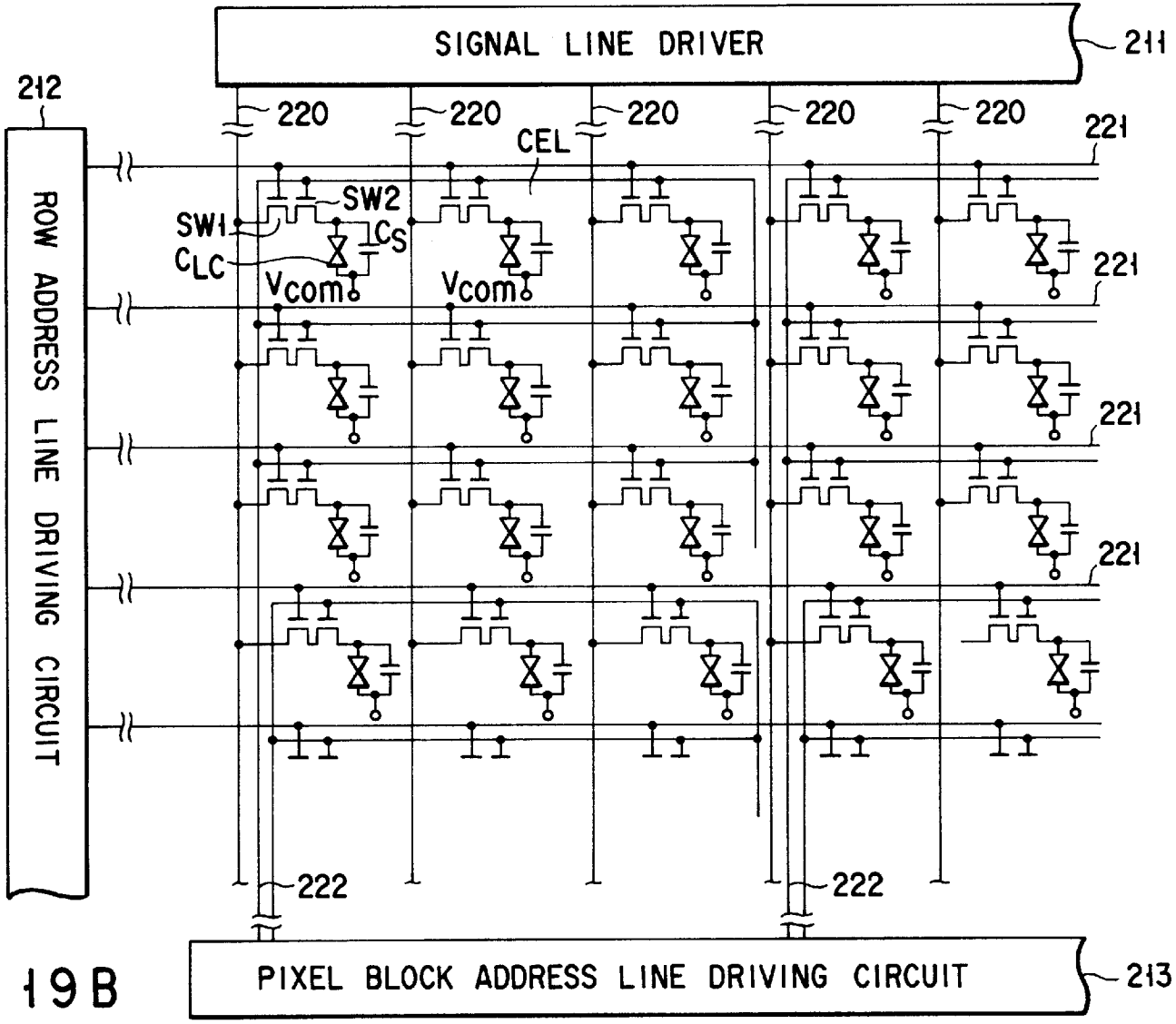

FIG. 19A is a view showing the configuration of the main parts of a liquid crystal display according to the fifth embodiment of the present invention. FIG. 19B shows the cell construction of a liquid crystal panel to be selected for each pixel.

As shown in FIG. 19A, the liquid crystal display of this embodiment comprises a liquid crystal display panel 210, a signal line driver 211, a row address line driving circuit 212, a row pixel counter circuit 214, a row address signal generating circuit 216, a pixel block address line driving circuit 213, a pixel block counter circuit 215, and a pixel block address signal generating circuit 217.

Figure 20A:
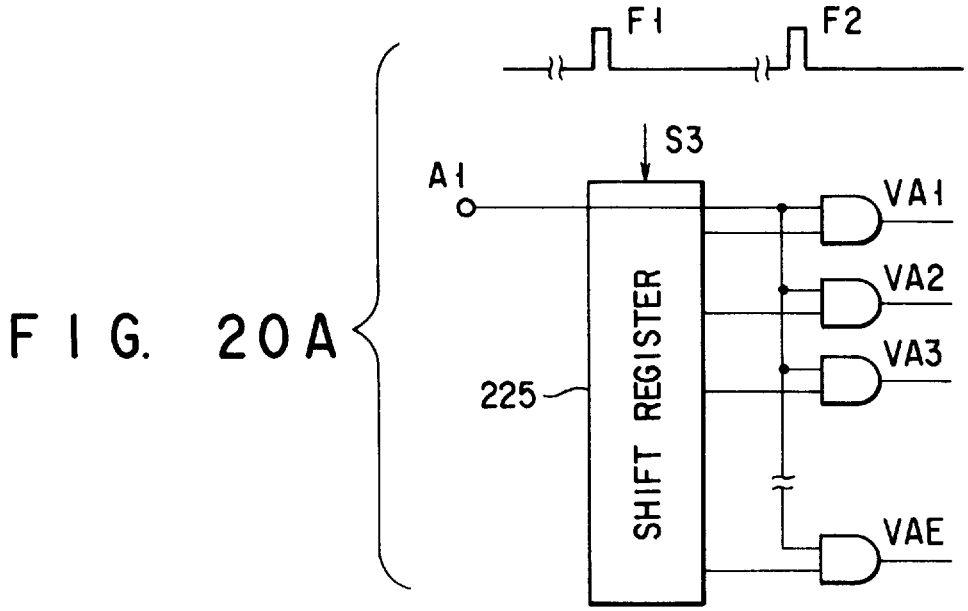
FIGS. 20A and 20B are views showing the signal processing manners of row and column address line driving circuits, respectively, of the display in FIG. 19A.

FIG. 19B shows the cell construction of the liquid crystal panel to be selected for each pixel. FIG. 20A shows the processing manner of the row address line driving circuit 212.

In the liquid crystal panel 210, a plurality of pixels are arranged in a matrix manner. As illustrated in FIG. 19B, row address lines 221 and signal lines 220 are arranged in the row and the column directions, respectively, in the liquid crystal panel 210. The regions surrounded by the row address lines 221 and the pixel signal lines 220 constitute liquid crystal cells CEL serving as pixels.

The signal line driver 211 receives an input image signal and outputs to the signal line 220 a display signal of each pixel in a row being scanned by the row address line.

Each liquid crystal cell CEL consists of a first switching device SW1 using a TFT transistor, a second switching device SW2 using another TFT transistor, a liquid crystal unit $C_{LC}$, and a capacitor $C_S$. This embodiment makes use of a block driving manner in which the screen is divided into a plurality of regions and driving is performed in units of a region.

The gate of the first switching device SW1 is connected to the row address line 221. One of the source and the drain of the first switching device SW1 is connected to the signal line 220, and the other is connected to a pixel electrode of the liquid crystal unit $C_{LC}$ via the source and the drain of the second switching device SW2. The liquid crystal unit $C_{LC}$ has a structure in which a liquid crystal material is sandwiched between the pixel electrode and a counter electrode which opposes the pixel electrode. A common voltage Vcom is applied to the counter electrode. A storage capacitor $C_S$ is interposed between the pixel electrode and the counter electrode of the liquid crystal unit $C_{LC}$.

The gate of the second switching device SW2 is connected to a pixel block address line 222 of the block which the liquid crystal cell CEL belongs to. The pixel block address line 222 is provided for each block.

The row address line driving circuit 212 generates a signal for driving each row address line. The circuit 212 has output terminals in a one-to-one correspondence with the row address lines 221. The row address lines 221 are connected to these output terminals and given row address signals.

The row pixel counter circuit 214 is a counter which manages the positions of row pixels so that an image is displayed in accordance with the frame display control for a dynamic image. The circuit 214 generates a start signal S3 whenever a time (usually one frame) required to drive all address lines corresponding to pixels arranged in rows of the pixels arranged in a matrix manner in the liquid crystal display panel 210 elapses. Consequently, the output terminals independently output signals (row address signals) once in sequence during one frame period.

The row address signal generating circuit 215 generates a row address signal by which all rows can be sequentially selected row by row during one frame period at a timing corresponding to the frame display control. The row address signal generating circuit 215 generates a row address signal A1 for selectively scanning address lines arranged with respect to the rows.

The processing method of the row address signal generating circuit 215 of this embodiment is such that one frame (one frame image) is divided into a plurality of subfields and only a row address line including pixels to be selected is scanned, like in a multi-field driving method of lowering the driving frequency. Note that the multi-field driving method is a well-known technique and so a detailed description thereof will be omitted.

The row address line driving circuit 212 receives the start signal S3 from the row pixel counter circuit 214, and the row address signal A1 from the row address signal generating circuit 216. Upon receiving these signals, the circuit 212 generates a drive signal by which rows of pixels can be sequentially driven during one frame period. For this purpose, the row address line driving circuit 212 incorporates a shift register and shifts the start signal S3 in the row direction for each horizontal period. Signals to row address lines VA1, VA2, . . . , VAE are formed by ANDing the signal S3 shifted in a shift register 225 and the row address signal.

Figure 20B:
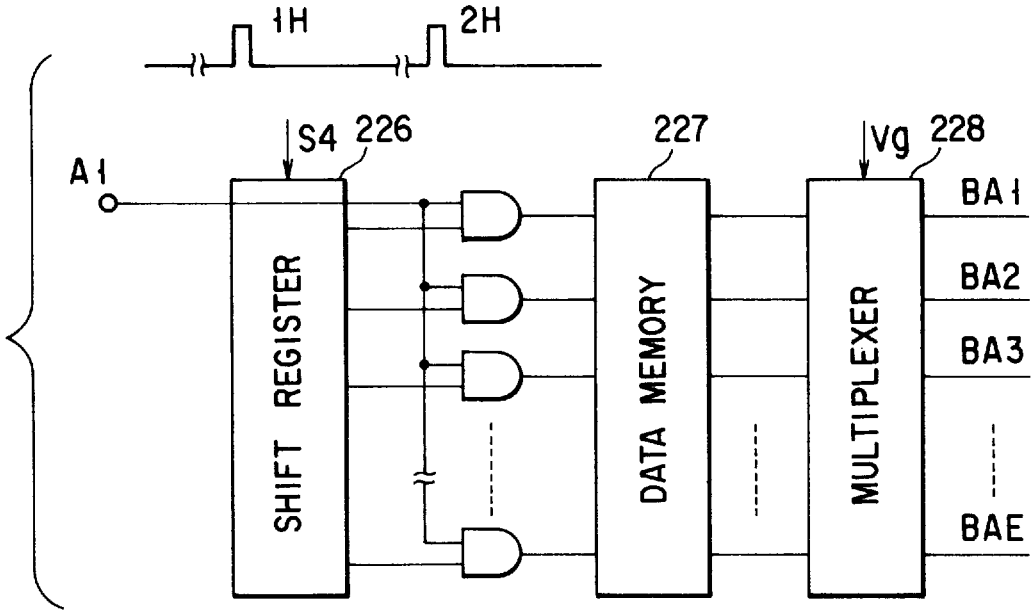

FIG. 20B shows the processing manner of the pixel block address line driving circuit 213. The pixel block counter circuit 215 generates a start signal S4 whenever a time (usually one horizontal time) required to drive all address lines corresponding to pixels arranged in units of a block elapses. The pixel block address signal generating circuit 217 generates the pixel block address signal A2 for selectively scanning address lines arranged for a pixel block to be selected.

The processing method of the pixel block address signal generating circuit 217 is not particularly limited. The driving frequency is low because one horizontal image (an image of one horizontal line) is divided into a plurality of blocks.

The pixel block address line driving circuit 213 incorporates a shift register, a data memory corresponding to the address lines, and a multiplexer. The circuit 213 shifts the start signal S4 and records the AND of the signal S4 and the block address signal A2 in the data memory. The data memory records information for selecting gate voltage outputs to pixel block address lines BA1, BA2, . . . , BAE. The multiplexer controls the gate voltage outputs.

FIG. 19B shows the cell construction of the liquid crystal display panel 210 to be selected for each pixel. The basic cell construction described above consists of the liquid crystal unit $C_{LC}$, the storage capacitor $C_S$, and the switching devices SW1 and SW2. The switching device SW1 is connected to the row address line 221, and the switching device SW2 is connected to the pixel block address line 222.

When an ON voltage is applied from the row address line driving circuit 212 through the row address line 221, the switching devices SW1 whose gates are connected to the row address line 221 are turned on. When an ON voltage is applied from the pixel block address line driving circuit 213 through the pixel block address line 222, the switching devices SW2 whose gates are connected to the pixel block address line 222 are turned on.

Consequently, of the plurality of pixels (liquid crystal cells), image signals from the pixel signal lines can be applied to only pixels whose switching devices SW1 and SW2 are simultaneously turned on when the row address line driving circuit 212 and the pixel block address line driving circuit 213 apply ON voltages to the respective address lines. The pixel block address line 222 applies an ON signal in units of a pixel block, i.e., simultaneously turns on the switching devices SW2 of all pixels in the corresponding block. Accordingly, it is possible to select any arbitrary pixel block from the plurality of pixel blocks and drive the pixels in that block.

The image signal is applied from the pixel signal line 220 to the pixel whose switching devices SW1 and SW2 are simultaneously turned on, and is held in the capacitor $C_S$ of the pixel via the switching devices SW1 and SW2. After the image signal is applied to the capacitor $C_S$, the capacitor $C_S$ drives the liquid crystal unit $C_{LC}$ to display the image by using the image signal held in the capacitor $C_S$ until the image signal is rewritten.

Accordingly, of the plurality of pixel blocks, only blocks whose display contents need to be rewritten can be driven. Since the other blocks are not driven, dynamic images can be displayed with a low power consumption.

Figure 21A:
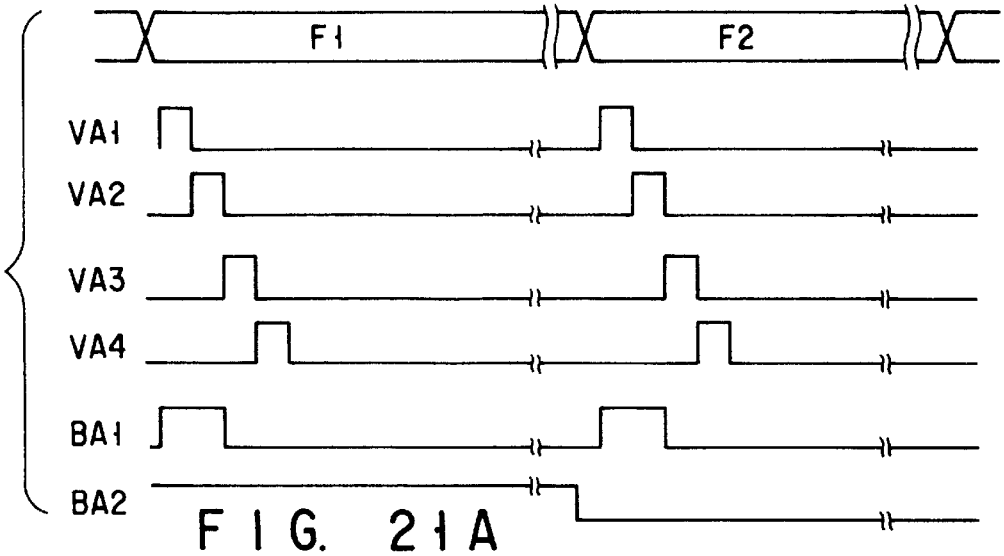
FIGS. 21A to 21D are views showing the signal waveforms of the individual components and the selected states of pixels, respectively, in the display shown in FIG. 19A.
Figure 21B:
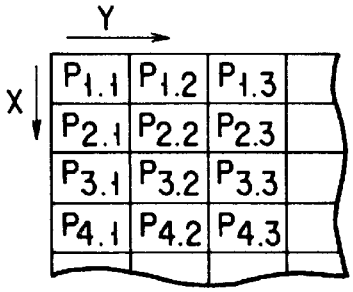
Figure 21C:
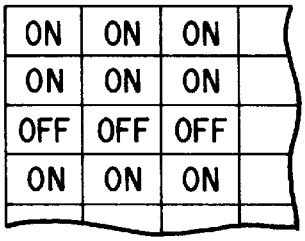
Figure 21D:
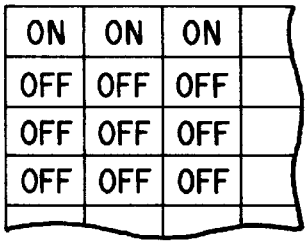

FIGS. 21A to 21D illustrate an operation when one block consists of 3×3 pixels. FIG. 21A shows the signal waveforms of the individual components in this embodiment. FIG. 21B shows the addresses of the individual pixels. FIGS. 21C and 21D illustrate the results of switching of the pixels in FIG. 21B done by the signal waveforms in FIG. 21A.

In FIG. 21B, a pixel address Pi,j indicates a pixel in row Xi and column Yj in a matrix consisting of X rows and Y columns. That is, Xi and Yj correspond to the row and the column addresses, respectively. Each pixel is switched by ANDing a row address VA and a column address BA.

Although the embodiment is explained by using a pixel block of 3×3 pixels, the numbers of pixels in blocks can be either the same or different, i.e., each block can contain any arbitrary number of pixels from one pixel. Another advantage of the block selection is a good matching with MPEG1 or MPEG2 which is standardized as a dynamic image compression transmission method.

More specifically, in the MPEG technology, an image is divided into blocks of 8×8 or 16×16 (16×8) pixels, and determination of the "presence" or "absence" of a motion and compression are done in units of a block of 8×8 or 16×16 (16×8) pixels. Accordingly, even when image information is selected in units of a pixel, the information is transferred in units of a block and hence cannot be effectively used. Therefore, it is preferable to divide the image information into blocks meeting the sizes of the blocks to be transmitted. Also, since address lines can be arranged in units of a block, the number of address lines in the panel can be decreased by blocking the address lines of a plurality of columns.

Figure 22:
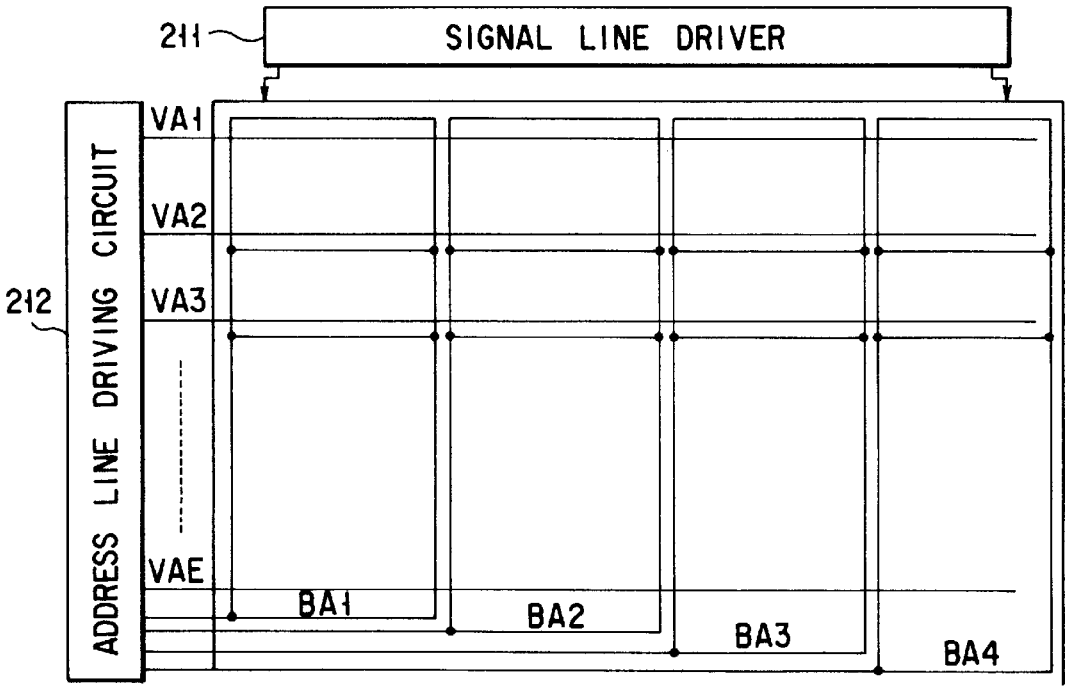
FIG. 22 is a view showing one example of the pixel block arrangement in the fifth embodiment.

Consequently, as illustrated in FIG. 22, it is possible to prevent an increase in the number of drivers by giving the row address line driving circuit a function similar to that of the pixel block address line driving circuit.

In the fifth embodiment as described above, a plurality of pixels arranged in a matrix manner are divided into blocks and can be driven in units of a block. Only blocks whose images are required to be rewritten are operated, and the other blocks are not operated. This can achieve a low power consumption.

Note that the connections of the switching devices SW1 and SW2 in the construction shown in FIG. 19B can be altered as shown in FIG. 4A. In this alteration, the signal line 220 and the pixel electrode are connected via the source and the drain of the switching device SW1, the pixel block address line 222 and the gate electrode of the switching device SW1 are connected via the source and the drain of the switching device SW2, and the gate electrode of the switching device SW2 is connected to the row address line 212.

(Sixth Embodiment)

The sixth embodiment reduces the power consumption by rewriting the contents of a given image signal only to a pixel required to be rewritten in a liquid crystal display which has capacitors $C_S$ as storage means for storing an image signal in a one-to-one correspondence with pixels.

In this sixth embodiment, each of a plurality of pixels arranged in a matrix manner has at least two switching devices and at least one rectifying device. Scan lines are arranged to control these switching devices, and an ON voltage is applied from the scan lines to the switching devices. The potential of a pixel electrode can be changed by the voltage applied to the rectifying device.

The rectifying device is provided in each of the pixels arranged in a matrix manner. This rectifying device is arranged between a signal line and a pixel electrode. Even when the switching device between the signal line and the pixel is turned on, a write operation to the pixel can be controlled by the relationship between the signal line potential and the pixel electrode potential. Accordingly, even when pixels arranged in the column direction are simultaneously selected by applying an ON voltage to scan lines such as in conventional displays, some rectifying devices are rendered nonconductive depending on the voltage applied to signal lines. As a consequence, no signal write is performed for pixel electrodes. Since even pixels arranged on the same scan line can be selectively written, the power consumption can be reduced.

Details of the sixth embodiment will be described below. In the sixth embodiment, of the plurality of pixels arranged in a matrix manner, a reset pulse is applied to individual pixels or pixel blocks each consisting of a plurality of pixels. Subsequently, arbitrary pixels arranged in the row direction are selectively driven.

Figure 23A:
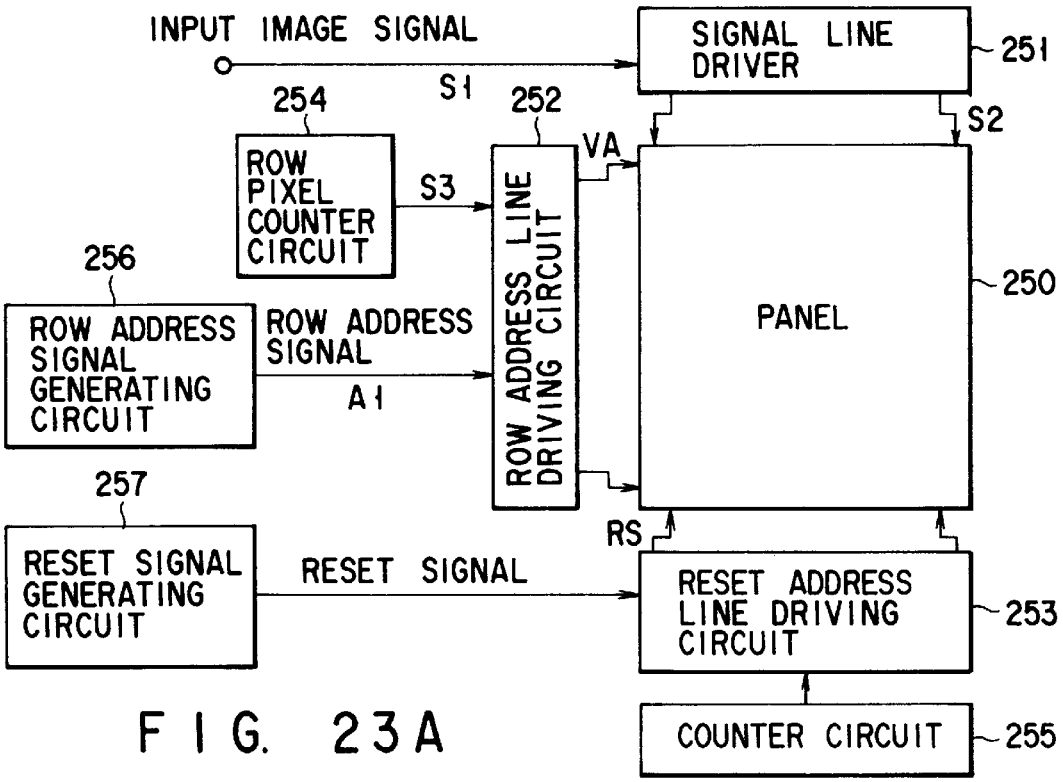
FIGS. 23A and 23B are views showing the configuration of the main components of a liquid crystal display according to a sixth embodiment of the present invention and the cell construction of a liquid crystal panel of the display, respectively.

FIG. 23A is a view showing the configuration of the major components of the liquid crystal display according to the sixth embodiment of the present invention. As shown in FIG. 23A, the liquid crystal display of this embodiment comprises a liquid crystal display panel 250 in which a plurality of pixels are arranged in a matrix manner, a signal line driver 251, a row address line driving circuit 252, a row pixel counter circuit 254, a row address signal generating circuit 256, a reset address line driving circuit 253, a reset counter circuit 255, and a reset signal generating circuit 257.

Figure 23B:
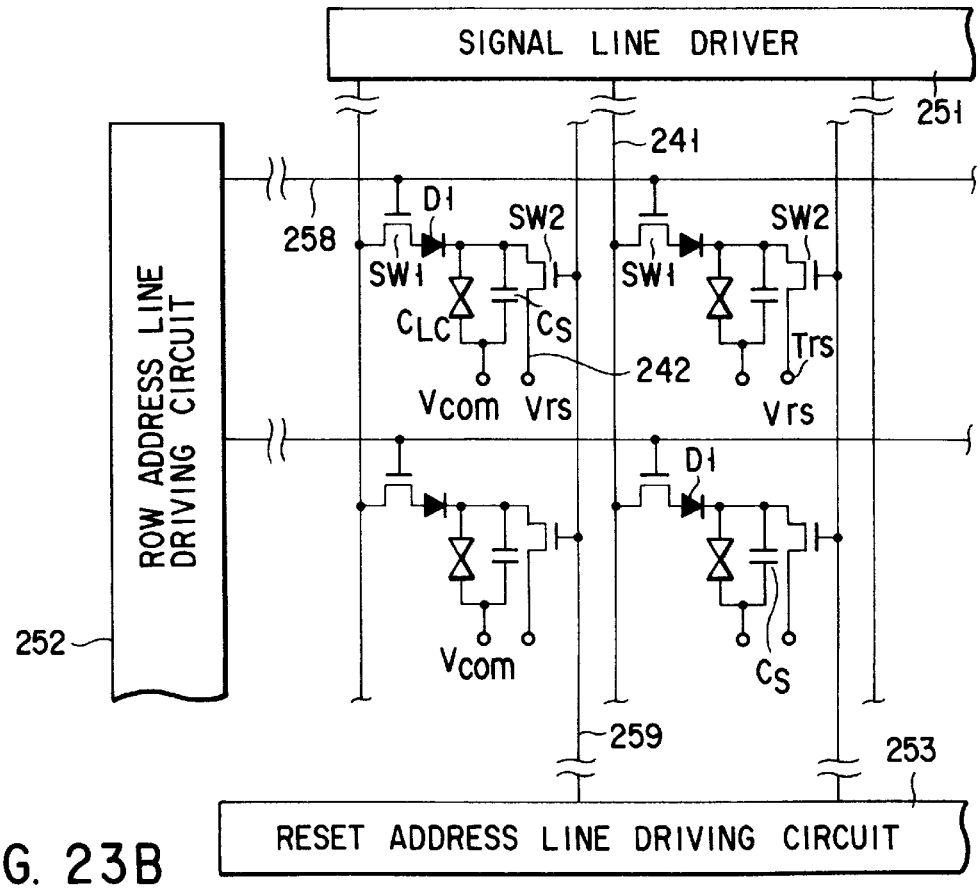

FIG. 23B shows the cell construction of the liquid crystal panel to be selected for each pixel. A basic cell construction consists of a liquid crystal unit $C_{LC}$, a storage capacitor $C_S$, switching devices SW1 and SW2, and a rectifying device D1.

The gate of the switching device SW1 is connected to a row address line 258. Each of signal lines 241 arranged in a one-to-one correspondence with pixel columns and the anode of the diode D1 are connected via the source and the drain of the switching device SW1. The cathode of the diode D1 is connected to a pixel electrode of the liquid crystal unit $C_{LC}$.

The liquid crystal unit $C_{LC}$ has a structure in which a liquid crystal material is sandwiched between the pixel electrode and a counter electrode which opposes the pixel electrode. A common potential Vcom is applied to the counter electrode. The storage capacitor $C_S$ is interposed between the pixel electrode and the counter electrode of the liquid crystal unit $C_{LC}$.

The gate of the switching device SW2 is connected to a reset address line 259. The reset address line 259 is provided for each pixel column. The reset address lines 259 can also be provided in a one-to-one correspondence with pixel blocks each consisting of a plurality of adjacent pixels. The source and the drain of the switching device SW2 connect the pixel electrode of the liquid crystal unit $C_{LC}$ to a reset signal line 242. The reset signal line 242 is connected to a terminal Trs for supplying a reset signal or pulse Vrs.

In this construction, when the reset address line driving circuit 253 applies an ON voltage to the reset address line 259, the reset signal Vrs is given to the pixel electrodes of pixels whose switching devices SW2 are turned on. The reset signal Vrs is lower than a minimum signal voltage Vmin to be given as the pixel electrode potential.

The row address line driving circuit 252 then selects row address lines in a line sequential manner. An image signal Vsig corresponding to image data is applied to pixel signal lines of pixels (generally, pixels applied with a reset pulse) to be rewritten. A voltage Voff by which the rectifying device D1 is rendered nonconductive is applied to pixel signal lines of pixels not to be rewritten.

That is, the signal line driver 251 outputs an image signal Vsig corresponding to image data to pixel signal lines of pixels (usually, pixels applied with a reset pulse) to be rewritten, and outputs the voltage of the level Voff to pixel signal lines of pixels not to be rewritten. This voltage of level Voff is a voltage by which the rectifying device D1 is rendered nonconductive.

An example of the relationship between these voltages is as follows:

$$Voff \leqq Vrs \leqq Vmin \leqq Vsig \quad (1)$$

Accordingly, the diode D1 connected to the switching device SW1 applied with an ON signal from the row address line is turned on or off in accordance with the voltage of the image data applied from the pixel signal line. The reset address line driving circuit 253 applies a reset signal to the switching device SW2 of a pixel to be rewritten. The switching device SW2 of each pixel applied with the reset signal is turned on, the reset voltage Vrs from the reset pulse terminal Trs is supplied to the pixel electrode and storage capacitor $C_S$ of the pixel, and the pixel electrode and storage capacitor $C_S$ are set at the reset voltage Vrs.

In the construction as described above, image data is supplied to the diode D1 via the switching device SW1 in the ON state, and the diode D1 is rendered conductive or nonconductive in accordance with the contents of the image data and the holding voltage of the pixel electrode and storage capacitor $C_S$ of the pixel. Consequently, the diode D1 of a pixel required to be written is rendered conductive and the pixel data is supplied to the pixel electrode and storage capacitor $C_S$ of the pixel, so that the pixel data is held in and used in image display by the liquid crystal unit $C_{LC}$. On the other hand, since the diode D1 of a pixel not required to be rewritten is rendered nonconductive, no current flows to the storage capacitor $C_S$ of the pixel, and the power consumption is reduced accordingly.

When a full screen rewrite is necessary, a reset pulse is applied to pixels to be rewritten. Since the pixel electrode and storage capacitor $C_S$ of each pixel applied with the reset pulse is at the reset voltage Vrs, it is necessary to rewrite the pixel. Therefore, image data is supplied to the diode D1 via the switching device SW1 in the ON state to render the diode D1 conductive or nonconductive in accordance with the contents (voltage level) of the image data. Consequently, the pixel is rewritten in accordance with the pixel data.

Note that image information can also be output to pixels required to be rewritten from, e.g., a frame memory provided in another stage. Note also that it is particularly desirable to determine a region in which rewriting is frequently performed on the display screen and to use this embodiment for display control in this region.

As described above, a rectifying device (diode) is provided in each of pixels arranged in a matrix manner. This rectifying device is arranged between a pixel signal line and a pixel electrode of a liquid crystal. Accordingly, even when a switching device between the pixel signal line and the pixel is turned on, a write action to the pixel can be controlled in accordance with the relationship between the signal line potential and the pixel electrode potential. As an example, even when an ON voltage is applied to a scan line of pixels arranged in the column direction and these pixels are simultaneously selected, some rectifying devices are rendered nonconductive depending on the voltage applied to the pixel signal lines, and so no signal is written in the corresponding pixel electrodes. Therefore, even pixels arranged on the same scan line can be selectively written. In this case it is necessary to reset an image signal of the preceding field for each pixel to be rewritten. For this purpose, the potential of the pixel electrode and storage capacitor of the pixel is set at a reset potential via another switching device of the pixel, thereby matching the pixel electrode potential with the reset voltage Vrs. With this construction, it is possible to minimize the frequency of rewrite operations and thereby reduce the power consumption.

(Seventh Embodiment)

In the seventh embodiment, one pixel includes two switching devices and two rectifying devices, and two scan lines for controlling the switching devices are provided for each pixel. These scan lines select different phases, and write and erase actions to the pixel can be controlled in accordance with the relationship between the signal line potential and the pixel electrode potential. Application of a reset pulse and selective driving are performed in units of a pixel or a pixel block consisting of a plurality of pixels.

Figure 24A:
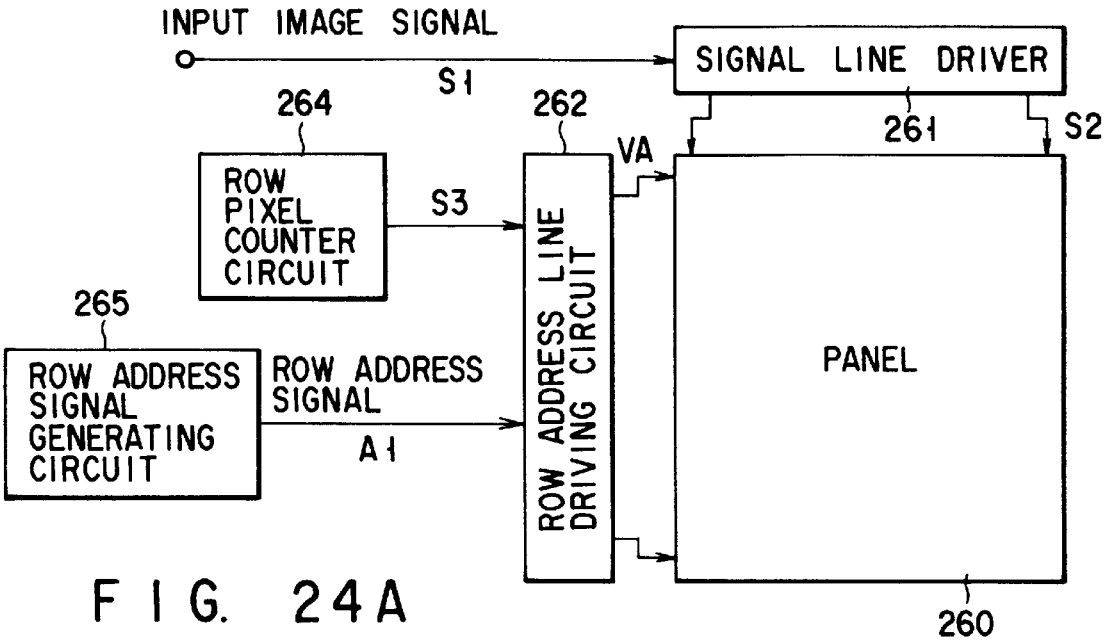
FIGS. 24A and 24B are views showing the configuration of the main components of a liquid crystal display according to a seventh embodiment of the present invention and the cell construction of a liquid crystal panel of the display, respectively.

FIG. 24A is a view showing the configuration of the major components of a liquid crystal display according to the seventh embodiment of the present invention. As shown in FIG. 24A, the liquid crystal display of this embodiment comprises a liquid crystal display panel 260, a signal line driver 261, a row address line driving circuit 262, a row pixel counter circuit 264, and a row address signal generating circuit 265.

Figure 24B:
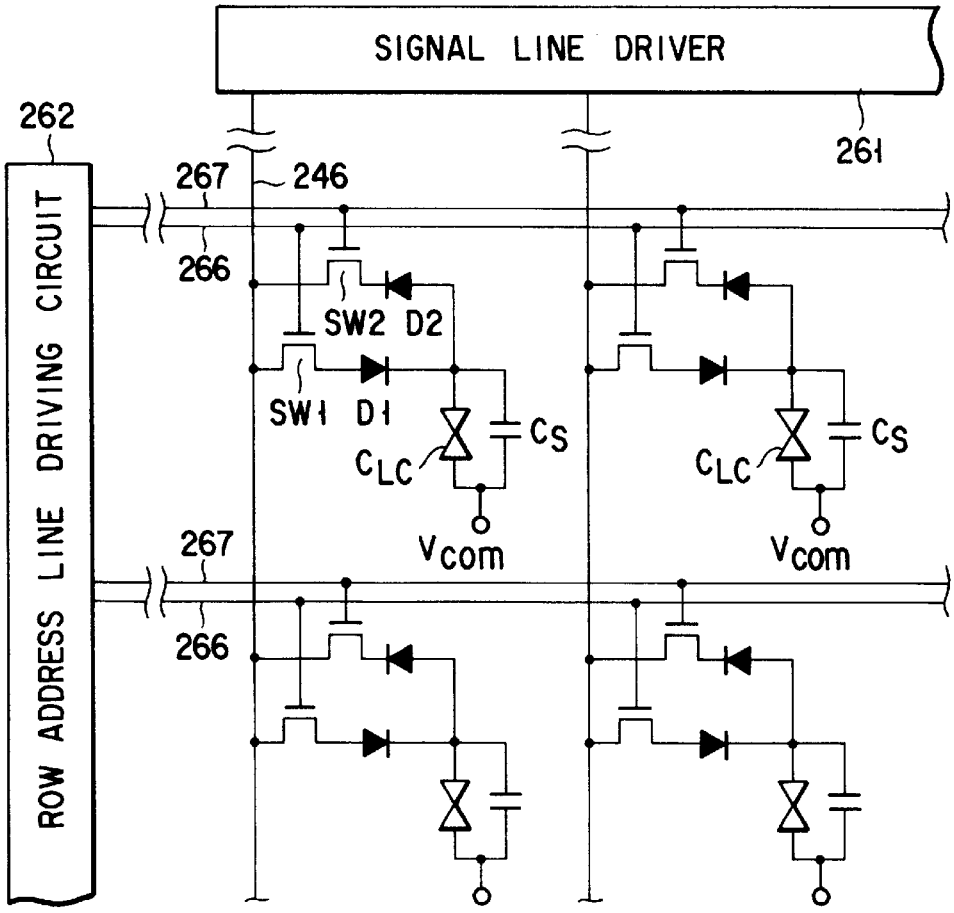

FIG. 24B shows the cell construction of the liquid crystal panel to be selected for each pixel. A basic cell construction consists of a liquid crystal unit $C_{LC}$, a storage capacitor $C_S$, switching devices SW1 and SW2, and rectifying devices D1 and D2. The gate of the switching device SW1 is connected to a row address line 266. The gate of the switching device SW2 is connected to a reset address line 267. The storage capacitor $C_S$ is connected between a pixel electrode and a counter electrode of the liquid crystal unit $C_{LC}$. A signal line 246 and the pixel electrode of the liquid crystal unit $C_{LC}$ are connected via the rectifying device D1 connected in the forward direction and the source and the drain of the switching device SW1. A pixel signal line and the pixel electrode of the liquid crystal unit $C_{LC}$ are connected via the rectifying device D2 connected in the reverse direction and the source and the drain of the switching device SW2.

The signal line driver 261 can output pixel data corresponding to an image, a reset signal at a voltage level Vrs, and a non-rewrite signal at a voltage level Vns. The row address line driving circuit 262 applies an ON signal to the reset address line 267. Of pixels whose switching devices SW2 are turned on, the reset signal Vrs is applied from the signal line 246 to pixels to be rewritten, and the non-rewrite signal Vns is applied to pixels not to be rewritten.

In this case, the reset signal Vrs is lower than a minimum signal voltage Vmin to be applied as a pixel electrode potential and the signal Vns is higher than a maximum signal voltage Vmax to be applied as the pixel electrode potential. An ON voltage is then applied to the row address line 266. Of pixels whose switching devices SW1 are turned on, an image signal (pixel data) Vsig is applied from the signal line 246 to pixels to be rewritten, and the signal Vrs is applied to pixels not to be rewritten.

An example of the relationship between these voltages is as follows:

$$Vrs \leqq Vmin \leqq Vsig \leqq Vmax \leqq Vns \quad (2)$$

The address lines 266 and 267 can be routed from either the same row address line driving circuit or different row address line driving circuits.

As described above, one pixel includes two switching devices and two rectifying devices, and two scan lines for controlling the switching devices are provided for each pixel. These scan lines select different phases, and write and erase operations to the pixel can be controlled in accordance with the relationship between the signal line potential and the pixel electrode potential. The two rectifying devices are rendered conductive in opposite directions. Therefore, even when pixels arranged in the column direction are applied with an ON voltage from the scan lines and simultaneously selected such as in conventional displays, some rectifying devices are rendered nonconductive depending on the voltage applied to the signal lines. Consequently, signal write and erase are not performed for the corresponding pixel electrodes, and this achieves a low power consumption. Also, since the two scan lines are arranged only in the column direction, a panel construction which can be realized only by one row address line driving circuit or in which two row address line driving circuits are arranged on one side is accomplished. This avoids an increase in the frame size caused by an increase in the number of drivers.

(Eighth Embodiment)

In the eighth embodiment, a signal line driver for driving pixel signal lines and a column address line driving circuit for driving column address lines are arranged on the same side with respect to the display screen, thereby avoiding an increase in the frame size caused by an increase in the number of drivers.

Figure 25A:
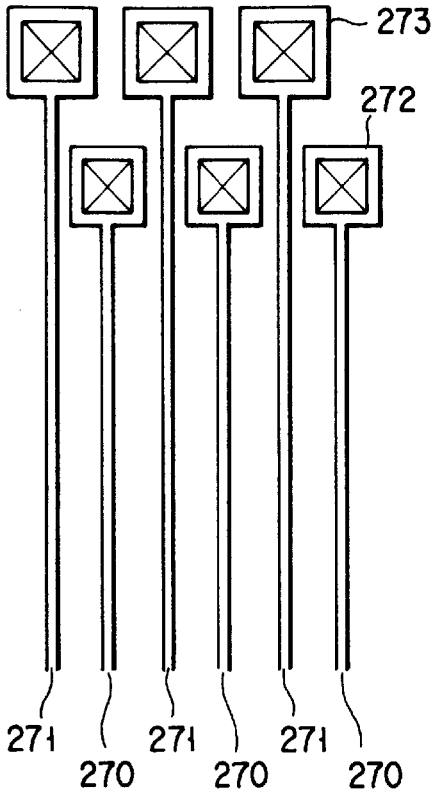
FIGS. 25A to 25C are views showing the wiring arrangement of a liquid crystal display according to an eighth embodiment of the present invention.

FIG. 25A shows an array construction in the peripheral portion of a panel of a liquid crystal display according to the eighth embodiment of the present invention. Reference numeral 270 denotes pixel signal lines; 271, column address lines; 272, pads of the pixel signal lines; and 273, pads of the column address lines. The liquid crystal display of this embodiment comprises the pixel signal lines for transmitting image signals to the pixels, a signal line driver for supplying the image signals to these pixel signal lines, row and column address lines arranged perpendicularly to each other to select the respective pixels, a row address line driving circuit for supplying a scan signal to the address lines arranged in the row direction, and a column address line driving circuit for supplying a scan signal to the address lines arranged in the column direction. The liquid crystal display uses a display method by which pixels can be selectively scanned. The column address line driving circuit and the signal line driver are arranged on the same side with respect to the display screen.

Consequently, for example, as illustrated in FIG. 25A, the length of the column address lines 271 is made different from that of the pixel signal lines 270, so that the pads 272 of the pixel signal lines and the pads 273 of the column address lines are not arranged in a line in the horizontal direction.

Figure 25B:
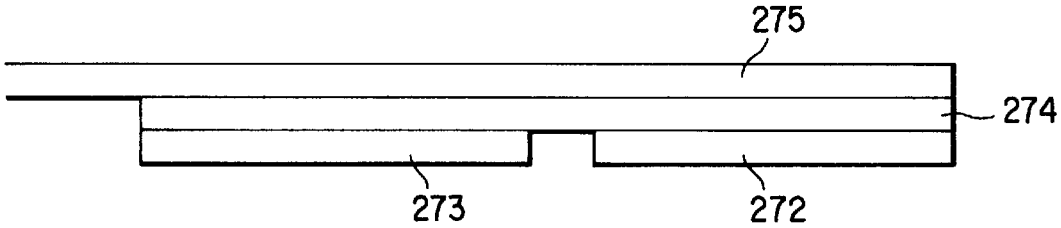

FIG. 25B shows a contact portion between the pads and a tab line 275. The pads and the tab line are conducted through, e.g., an anisotropic conductive film 274. The use of the anisotropic conductive film allows the signal line driver and the column address line driving circuit to be mounted on the same tape carrier. Accordingly, an increase in the number of column address lines does not increase the area of the module.

Figure 25C:
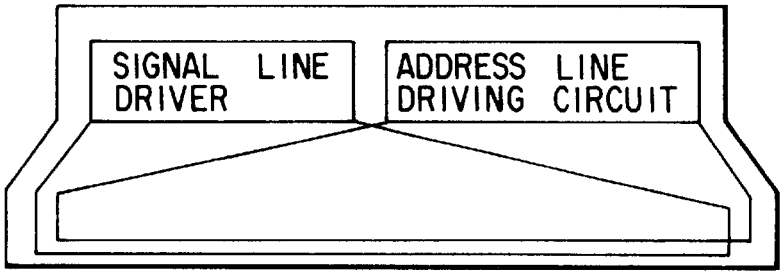

FIG. 25C shows the construction in which the signal line driver and the column address line driving circuit are packaged on the same tape carrier.

(Ninth Embodiment)

In the ninth embodiment, in a liquid crystal display in which a plurality of pixels are arranged in a matrix manner, the polarity of one pixel is inverted from that of an adjacent pixel upon writing to compensate for flicker which occurs due to different luminances of pixels resulting from different polarities.

Figure 26:
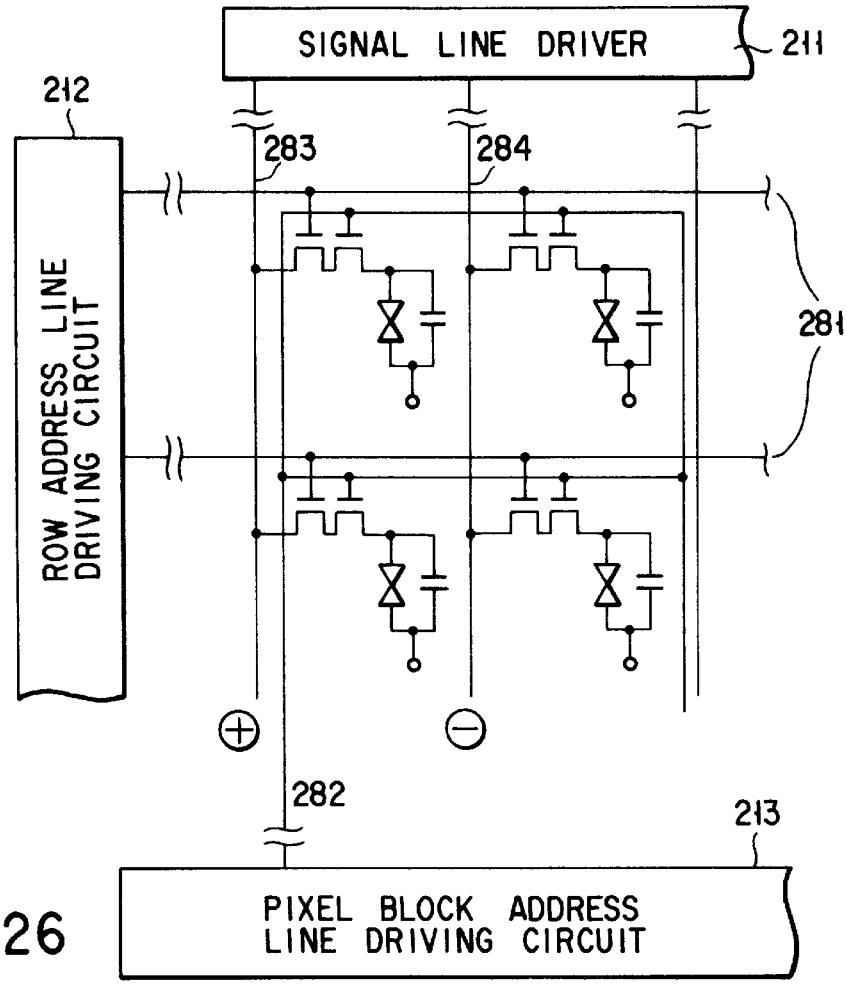
FIG. 26 is a view showing the cell construction of a liquid crystal cell of a liquid crystal display according to a ninth embodiment of the present invention.

FIG. 26 shows the cell construction of a liquid crystal panel to be selected for each pixel. A basic cell construction is nearly identical with that of the fifth embodiment and consists of a liquid crystal unit $C_{LC}$, a storage capacitor $C_S$, and switching devices SW1 and SW2. The switching device SW1 is connected to a row address line 281. The switching device SW2 is connected to a pixel block address line 282. One pixel block consists of pixels connected to different signal lines.

A row address line driving circuit 212 applies an ON signal to the address lines 281. Image signals are applied from pixel signal lines 283 and 284 to pixels whose switching devices SW1 and SW2 are simultaneously turned on. The pixel signal lines 283 and 284 apply image signals with different polarities.

It is desirable that in a selected pixel block, the number of pixels to which writing in the + (positive) polarity is performed be almost the same as the number of pixels to which writing in the − (negative) polarity is performed. It is also desirable that the polarity inverting method switch the polarities every several frames.

As described above, when the luminance difference between pixels caused by the difference between the polarities upon writing appears as flicker, this embodiment can compensate for this flicker by making adjacent pixels have different polarities. As is well known in a multi-field driving method, the polarity need not be inverted for each adjacent pixel but can be inverted in units of a plurality of pixel blocks or over a plurality of fields. As a consequence, good image quality can be maintained because flicker does not occur in a region which is visually recognized in the visual spatio-temporal frequency characteristic.

(Tenth Embodiment)

The tenth embodiment relates to a technique which lowers the frequency of an operating clock. The tenth embodiment is characterized in that when one row includes both pixels to be rewritten and pixels not to be rewritten, a clock is converted in accordance with the address of an image signal.

Figure 27:
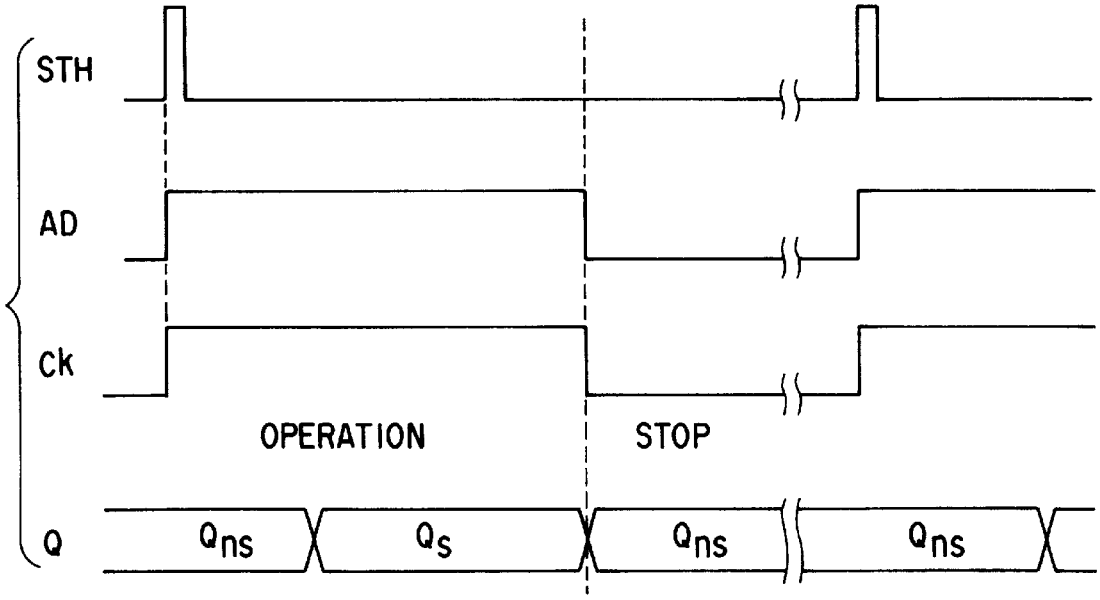
FIG. 27 is a view showing the signal waveforms of the individual components of a liquid crystal display according to a tenth embodiment of the present invention.

FIG. 27 shows the signal waveforms of individual components according to the tenth embodiment of the present invention. A signal line driver 211 for receiving an image signal and outputting pixel data to pixel signal lines is applied with image data Q as the image signal, a clock CK, and an address signal AD. In this embodiment, the clock CK is not continuously generated, i.e., a stop period is provided as in FIG. 27.

As shown in FIG. 27, the image data Q includes image data Qs for pixels to be rewritten and image data Qns for pixels not to be rewritten. Reference symbol STH denotes a start pulse. The signal line driver 211 is provided with shift registers which are operated by the clock CK to shift the image data. The start pulse STH instructs the start of image data input to the first shift register in the signal line driver 211.

In the signal line driver 211 of this embodiment, image data input to the shift registers is started after the start pulse is input. Since the clock CK is controlled by the address signal AD, the number of shifts of the image data Q also is controlled. However, image data to pixels to be rewritten must be input to the signal line driver 211 by a control circuit in synchronism with the pulse STH. Although not shown, the control circuit is the control center of the liquid crystal display.

Even when one line of an image includes both pixels to be rewritten and pixels not to be rewritten, it is only necessary to input image data of the same row, such that those having larger numbers of shifts are provided with priority, to the signal line driver in synchronism with the pulse STH.

In this embodiment as described above, when pixels not to be rewritten exist, it is possible to stop the clock to the signal lines or lower the frequency of the clock in accordance with the addresses of pixels to be rewritten. Consequently, the power consumed by the clock in the signal line driver and the power consumed to shift the image data can be reduced.

Figure 28:
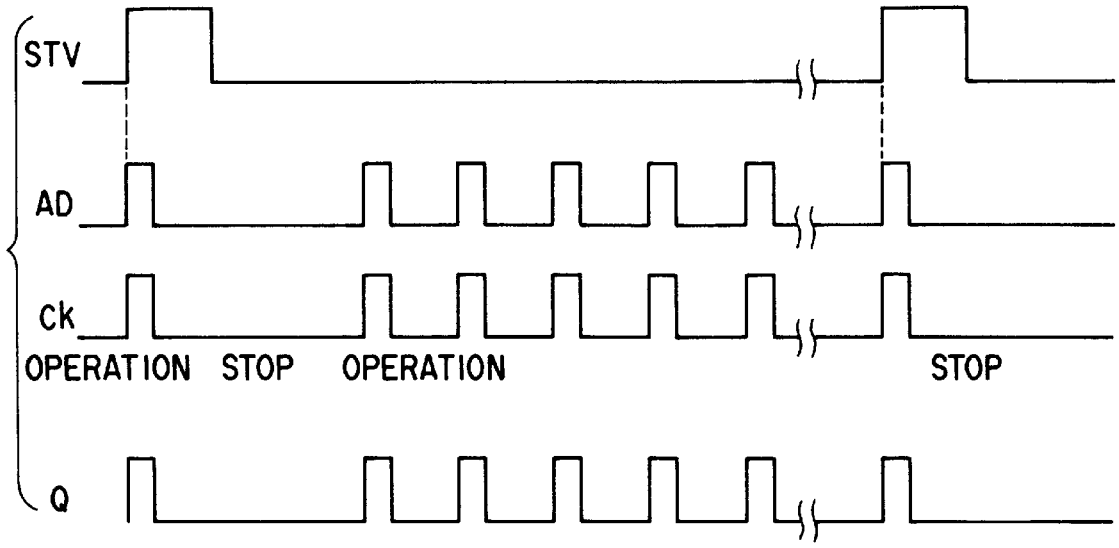
FIG. 28 is a view showing the signal waveforms of the individual components of a modification of the liquid crystal display in FIG. 27.

FIG. 28 shows the signal waveforms of individual components according to a modification by which the clock frequency is lowered. In this modification, in synchronism with a start pulse STV which instructs the start of image input of one frame, image data for pixels to be rewritten by one frame is started to be serially input to a signal line driver regardless of write lines.

The image data can be input only while the clock is input. However, an output from a control panel is converted in accordance with an address signal, and so image data of one line need not be sent in units of a block. Also, the frequency of the clock can be decreased in accordance with the display image without stopping the clock.

(Eleventh Embodiment)

In the eleventh embodiment, in a liquid crystal display capable of selecting arbitrary pixels and having a memory function somewhere in the display, a display signal is transmitted only to a portion to be rewritten, i.e., the signal is not transmitted to a portion not to be rewritten. In this manner the power consumed by the transmission signal is greatly reduced.

Figure 29:
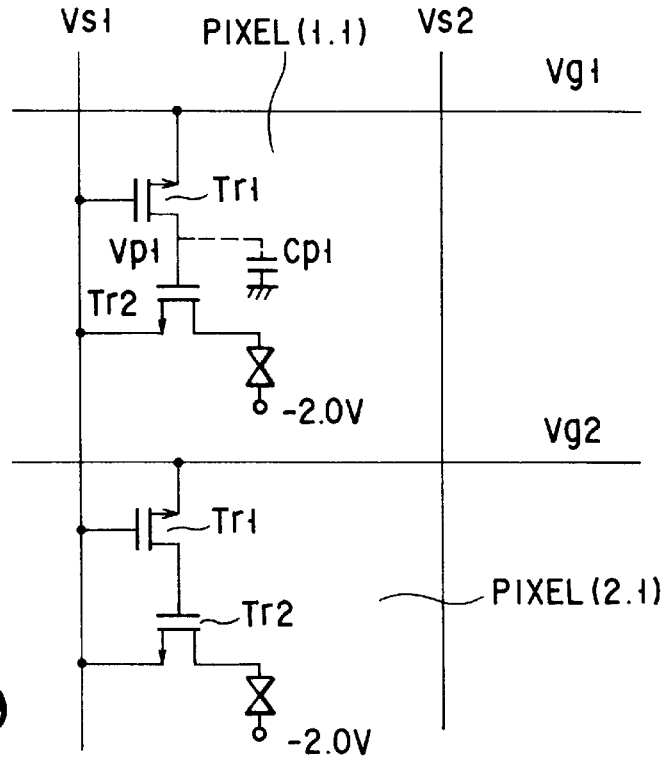
FIG. 29 is a view showing the cell construction of a liquid crystal panel of a liquid crystal display according to an eleventh embodiment of the present invention.
Figure 30A:
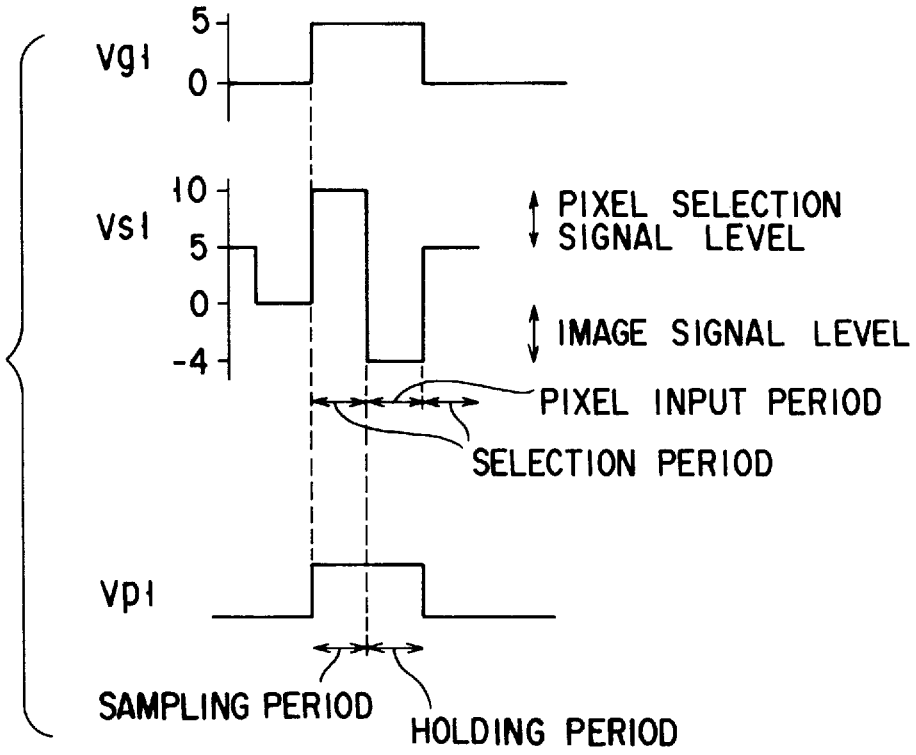
FIGS. 30A and 30B are views showing the driving timings of the liquid crystal display in FIG. 29.
Figure 30B:
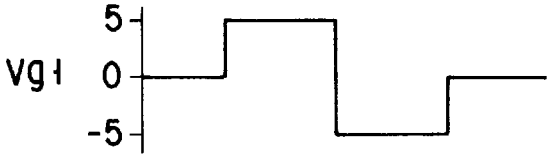

FIG. 29 shows the configuration of the eleventh embodiment, and FIGS. 30A and 30B illustrate driving timing charts. In FIG. 29, Vth of TFT transistors Tr1 and Tr2 as switching devices is 4 [V]. Vg1 as a selection signal is 5 [V] when ON and 0 [V] when OFF. Vs1 is applied with the selection signal during a certain period and is applied with a pixel signal during another certain period. While the selection signal is applied, Vs1 is 10 [V] when ON and 5 [V] when OFF. While the pixel signal is applied, Vs1 varies from 0 to −4 [V]. Note that the driving voltage is 2 [V] in the case of AC driving.

The timing chart in FIG. 30A shows a case where a pixel (1,1) is selected and written. First, Vg1 and Vs1 are simultaneously selected; that is, Vg1 is 5 [V] and Vs1 is 10 [V].

Accordingly, the transistor Tr1 is turned on and a selection signal of 5 [V] is written in Vp1. When Vs1 is changed to −4 [V] as an image signal, the transistor Tr1 is turned off and the selection signal is held. During this hold period the image signal is written via the transistor Tr2. Vg1 is released from the selected state and dropped to 0 [V], and at the same time Vs1 is returned to the range of the selection signal of 5 to 10 [V]. Consequently, the transistor Tr1 is turned on and a non-selection signal is written as Vp1.

Thereafter, Vg1 is not selected until the next selection period, and so the voltage of −4 [V] written in the pixel is held until the next selection period starts.

That is, as long as Vg1 is not selection, regardless of whether Vs1 is selection, a non-selection signal is written as a pixel selection signal via the transistor Tr1 during the period of a selection signal. Therefore, a capacitor Cp1 for holding the pixel selection signal needs to have a holding level only during the period in which the pixel signal is applied to Vs1. In situations where a parasitic capacitance alone is satisfactory for the purpose, it is not particularly necessary to provide the capacitor Cp1. Also, during the non-selection period, the transistor Tr2 is not turned on, since the image signal changes only between 0 and −4 [V], i.e., does not exceed 4 [V] as Vth of the transistor Tr2.

That is, the selection signal and the image signal can be separately supplied to the same signal line Vs1 by changing their signal levels. Additionally, to decrease the power consumption it is possible to output the same level (the non-selection signal level: in this embodiment 5 [V]) even for the image signal after the non-selection signal S is output, thereby setting the signal level such that the signal Vs1 itself does not vary. Also, to avoid a long OFF time which causes crosstalk, Vg1 can be given weak overshoot when switched off as illustrated in FIG. 30B.

Although n-channel TFTs are used in this embodiment, the present invention is also applicable when p-channel TFTs are used. In addition, the one-pixel selection is explained in this embodiment, but the present invention involves a case where pixels are selected in units of a block (e.g., 8×8 pixels or 16×16 pixels). MPEG2 will be used in the future to transmit dynamic images, and this compression processing is done in units of a block. Accordingly, the adaptability is improved when images are displayed in units of a block, and this also makes the MPEG information easy to use.

Since arbitrary pixels can be selected in units of a pixel as described above, a display signal can be transmitted only to a portion to be rewritten and this eliminates the need to transmit the signal to a portion not to be rewritten. As a consequence, the power consumed by a transmission signal can be greatly reduced in a liquid crystal display having a memory function somewhere in the display.

In the eleventh embodiment, arbitrary pixels can be selected in units of a pixel without newly providing selection signal lines in the column direction. Since rewriting is performed only for a portion in which an image has moved, the power consumption can be greatly reduced even for a dynamic image. Also, the signal line driver can be used for both the pixel voltage driving and the selection. Consequently, separate drivers can be arranged on one side, i.e., they need not be arranged on two sides. This realizes a narrow-frame structure of the liquid crystal panel. Furthermore, the power supply voltage is decreased by using different signal line drivers for the time-divided selection signal and image signal. This permits the use of low-voltage, low-cost drivers.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display comprising:

a pixel matrix defined by rows and columns of a plurality of pixels, each of said pixels having a pixel electrode;

an image signal supply for supplying an image signal to said pixels, said image signal supply comprising a plurality of signal lines for supplying an image signal to said pixel electrodes, a signal line driver for supplying an image signal to said signal lines, and a plurality of switching units for respectively connecting said signal lines to said pixel electrodes;

a first addressor for selecting said rows of said pixel matrix, said first addressor comprising a plurality of first address lines for selecting said rows of said pixel matrix, and a first address line driving circuit for supplying a scan signal to said first address lines; and a second addressor for selecting pixel groups each consisting of a plurality of pixels of said pixel matrix, said second addressor comprising a plurality of second address lines for selecting said pixel groups of said pixel matrix, and a second address line driving circuit for supplying a scan signal to said second address lines;

wherein an image signal is supplied to a pixel while said row and said pixel group, which said pixel belongs to, are selected, said switching unit is turned on and off by said first and second address lines, and an image signal is supplied to said pixel while said switching unit is turned on.

2. The display according to claim 1, wherein said pixel groups form said columns of said pixel matrix.

3. The display according to claim 1, wherein said pixel groups form pixel blocks each consisting of a plurality of adjacent pixels in said pixel matrix.

4. The display according to claim 1, wherein said switching unit comprises first and second switching elements which are turned on and off by said first and second address lines, respectively.

5. The display according to claim 4, wherein said first and second switching elements comprise first and second MOS transistors, respectively, said signal line and said pixel electrode are connected via a source and a drain of said first MOS transistor, said second address line and a gate of said first MOS transistor are connected via a source and a drain of said second MOS transistor, and a gate of said second MOS transistor is connected to said first address line.

6. The display according to claim 5, wherein a line connecting said drain of said second MOS transistor to said gate of said first MOS transistor is connected to a portion for holding a gate voltage of said first MOS transistor via a capacitor.

7. The display according to claim 4, wherein said first and second switching elements comprise first and second MOS transistors, respectively, said signal line and said pixel electrode are connected via a source and a drain of said first MOS transistor and a source and a drain of said second MOS transistor, and gates of said first and second MOS transistors are connected to said first and second address lines, respectively.

8. The display according to claim 1, further comprising first means for driving said switching units at different frequencies so as to rewrite said pixels on different cycles.

9. The display according to claim 8, wherein said first means comprises a driving frequency selector connected to said second address line driving circuit.

10. The display according to claim 8, wherein the frequency is selected in accordance with a display color.

11. The display according to claim 8, wherein the frequency is selected in accordance with whether a display image is a dynamic image or a still image.

12. The display according to claim 1, further comprising second means for supplying different voltages to said second address lines in accordance with image signals supplied to said pixel electrodes or potentials held by said pixel electrodes.

13. A liquid crystal display comprising:

a pixel matrix defined by rows and columns of a plurality of pixels each having a pixel electrode;

a plurality of signal lines for supplying an image signal to said pixel electrodes;

a signal line driver for supplying an image signal to said signal lines;

a plurality of first switching units for respectively connecting said signal lines to said pixel electrodes, each of said first switching units having a first switching element and a rectifying element;

a plurality of first address lines for selecting said rows of said pixel matrix, said first switching elements being turned on and off by said first address lines;

a first address line driving circuit for supplying a scan signal to said first address lines;

a plurality of reset signal lines for supplying a reset signal to said pixel electrodes;

a plurality of second switching units for connecting said reset signal lines to said pixel electrodes, each of said second switching units having a second switching element;

a plurality of second address lines for selecting pixel groups each consisting of a plurality of pixels of said pixel matrix, said second switching elements being turned on and off by said second address lines; and a second address line driving circuit for supplying a scan signal to said second address lines, wherein an image signal passes through said rectifying element corresponding to a pixel to which a reset signal has been supplied.

14. The display according to claim 13, wherein said pixel groups form said columns of said pixel matrix.

15. The display according to claim 13, wherein said pixel groups form pixel blocks each consisting of a plurality of adjacent pixels in said pixel matrix.

16. The display according to claim 13, wherein said first switching element and said rectifying element comprise a first MOS transistor and a diode, respectively, said signal line and said pixel electrode are connected via a source and a drain of said first MOS transistor and said diode connected in series with said first MOS transistor, and a gate of said first MOS transistor is connected to said first address line.

17. The display according to claim 13, wherein said second switching element comprises a second MOS transistor, said reset signal line and said pixel electrode are connected via a source and a drain of said second MOS transistor, and a gate of said second MOS transistor is connected to said second address line.

18. A liquid crystal display comprising:

a pixel matrix defined by rows and columns of a plurality of pixels each having a pixel electrode;

a plurality of signal lines for supplying an image signal and a reset signal to said pixel electrodes;

a signal line driver for supplying an image signal and a reset signal to said signal lines;

a plurality of first switching units for respectively connecting said signal lines to said pixel electrodes to supply an image signal to said pixel electrodes, each of said first switching units having a first switching element and a first rectifying element;

a plurality of second switching units for respectively connecting said signal lines to said pixel electrodes to supply a reset signal to said pixel electrodes, each of said second switching units having a second switching element and a second rectifying element, and said first and second rectifying elements performing rectification with opposite polarities between said signal line and said pixel electrode;

a plurality of first address lines for selecting said rows of said pixel matrix, said first switching elements being turned on and off by said first address lines;

a plurality of second address lines for selecting pixel groups each consisting of a plurality of pixels of said pixel matrix, said second switching elements being turned on and off by said second address lines; and an address line driving circuit for supplying a scan signal to said first and second address lines, wherein an image signal passes through said first rectifying element corresponding to a pixel to which a reset signal has been supplied through said second rectifying element.

19. The display according to claim 18, wherein said first switching element and said first rectifying element comprise a first MOS transistor and a first diode, respectively, said signal line and said pixel electrode are connected via a source and a drain of said first MOS transistor and said first diode connected in series with said first MOS transistor, and a gate of said first MOS transistor is connected to said first address line.

20. The display according to claim 18, wherein said second switching element and said second rectifying element comprise a second MOS transistor and a second diode, respectively, said signal line and said pixel electrode are connected via a source and a drain of said second MOS transistor and said second diode connected in series with said second MOS transistor, and a gate of said second MOS transistor is connected to said second address line.

* * * * *